United States Patent [19]

Guiraud

[11] 4,100,776

[45] Jul. 18, 1978

[54] COMBINATION LOCK FOR SAFES AND THE LIKE

[75] Inventor: François Guiraud, Chambourcy, France

[73] Assignee: Fichet-Bauche, Velizy, France

[21] Appl. No.: 751,639

[22] Filed: Dec. 17, 1976

[30] Foreign Application Priority Data

Dec. 31, 1975 [FR] France ..... 75 40357

[51] Int. Cl.[2] ..... E05B 37/12

[52] U.S. Cl. ..... 70/303 A; 70/311; 70/313; 70/316; 70/333 A

[58] Field of Search ..... 70/313, 315, 316, 317, 70/318, 292, 304, 305, 306, 311, 309, 310, 303 A, 333 A

[56] References Cited

U.S. PATENT DOCUMENTS

| | | | |
|---|---|---|---|
| 92,844 | 7/1889 | Lamb | 70/311 |
| 2,104,516 | 1/1938 | Hage | 70/311 X |
| 2,677,265 | 4/1954 | Bergendahl | 70/305 |
| 3,034,329 | 5/1962 | Pitney et al. | 70/316 X |
| 3,045,466 | 7/1962 | Herlong | 70/303 A |
| 3,423,972 | 1/1969 | Marti et al. | 70/305 |
| 3,801,761 | 4/1974 | Green | 70/311 X |
| 3,981,167 | 9/1976 | Philips | 70/311 |

*Primary Examiner*—Roy D. Frazier
*Assistant Examiner*—Thomas J. Holko
*Attorney, Agent, or Firm*—Ferrill and Logan

[57] ABSTRACT

Combination lock for the control of the retraction of a lock latch comprising a multiplicity of notched members each displaceable as a function of a numeral or number in the combination, in order that, upon display of the right combination, the notches are aligned with a device for retracting the latch, characterized in that said device comprises means such that, by acting on a same member for instance a button, in a first phase the rake can be moved towards engagement with the notches then aligned, and in a second phase the driving of the latch in a retraction movement can be ensured.

19 Claims, 90 Drawing Figures

Fig. 36
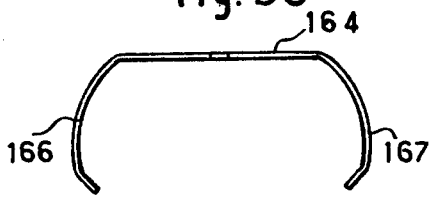
Fig. 37
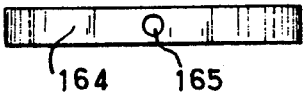
Fig. 39
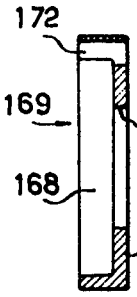
Fig. 38
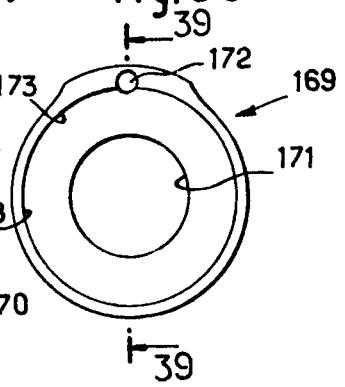
Fig. 67
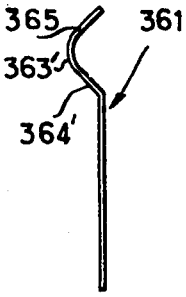
Fig. 66
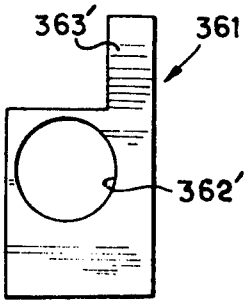
Fig. 69
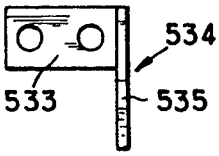
Fig. 68
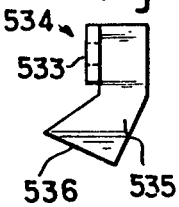
Fig. 70
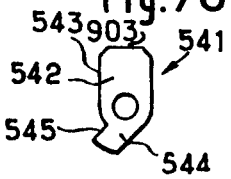
Fig. 71
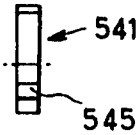
Fig. 72
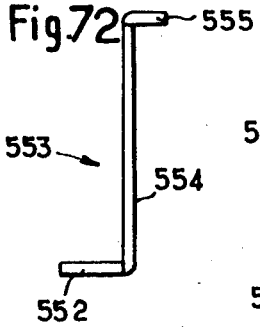
Fig. 75
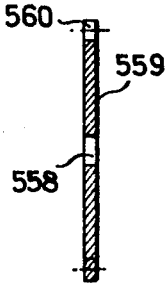
Fig. 74
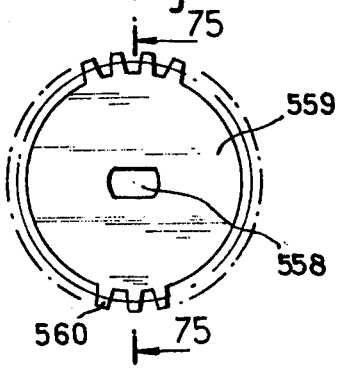
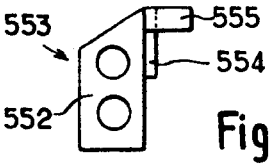
Fig. 73

Fig. 40
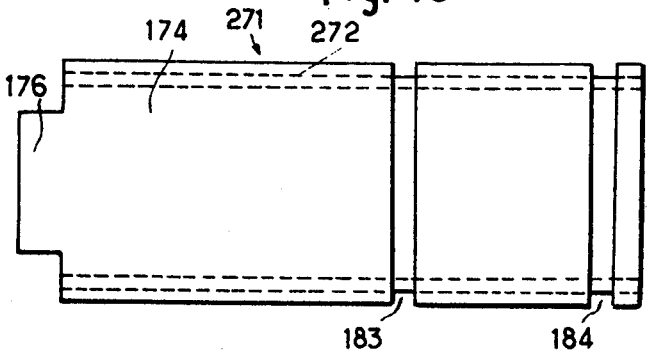
Fig. 41
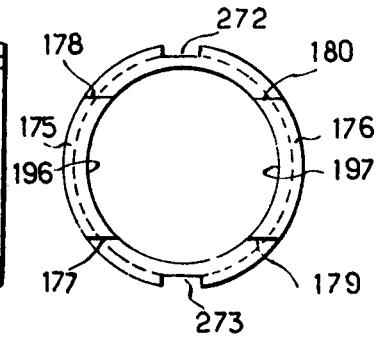
Fig. 42
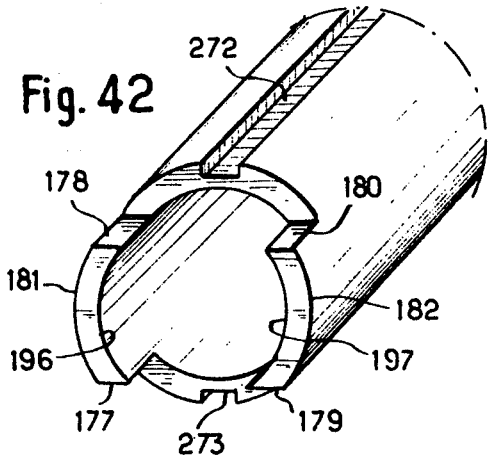
Fig. 44
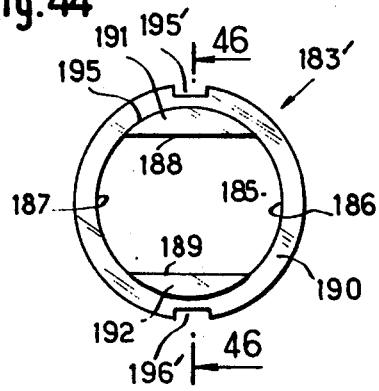
Fig. 46
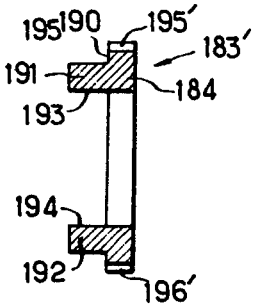
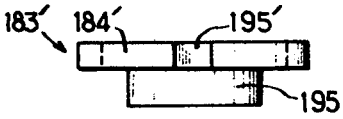
Fig. 45

514
515
516
517
518
519
520
521
522
59
295
296
297
298
299
300
301
303
304
52
53

351
252'
352
358
355
337o
334o
336o
333o
356
357
342
510
310
311
322
363
325
537
538
57
56
312
326
323
347
324
513
512
364

COMBINATION LOCK FOR SAFES AND THE LIKE

This invention has as its object a combination lock for safes and the like.

Protection against opening of the door of a safe or the like involves problems difficult to solve.

The combination lock according to this invention presents high security qualities while being of a simple constitution and consequently of a moderate cost price.

Its operation is easy. It is of the "counter" type and it comprises, on one hand a button for the sequential selection of each one of the counters, and, on the other hand, a button for the sequential displaying of the numbers or numerals of the combination. The selector button can take a position which corresponds to the opening, and the opening is then controlled by the operation of the displaying button.

In the following description, given as an example, reference is made to the accompanying drawing in which.

Figure 16:
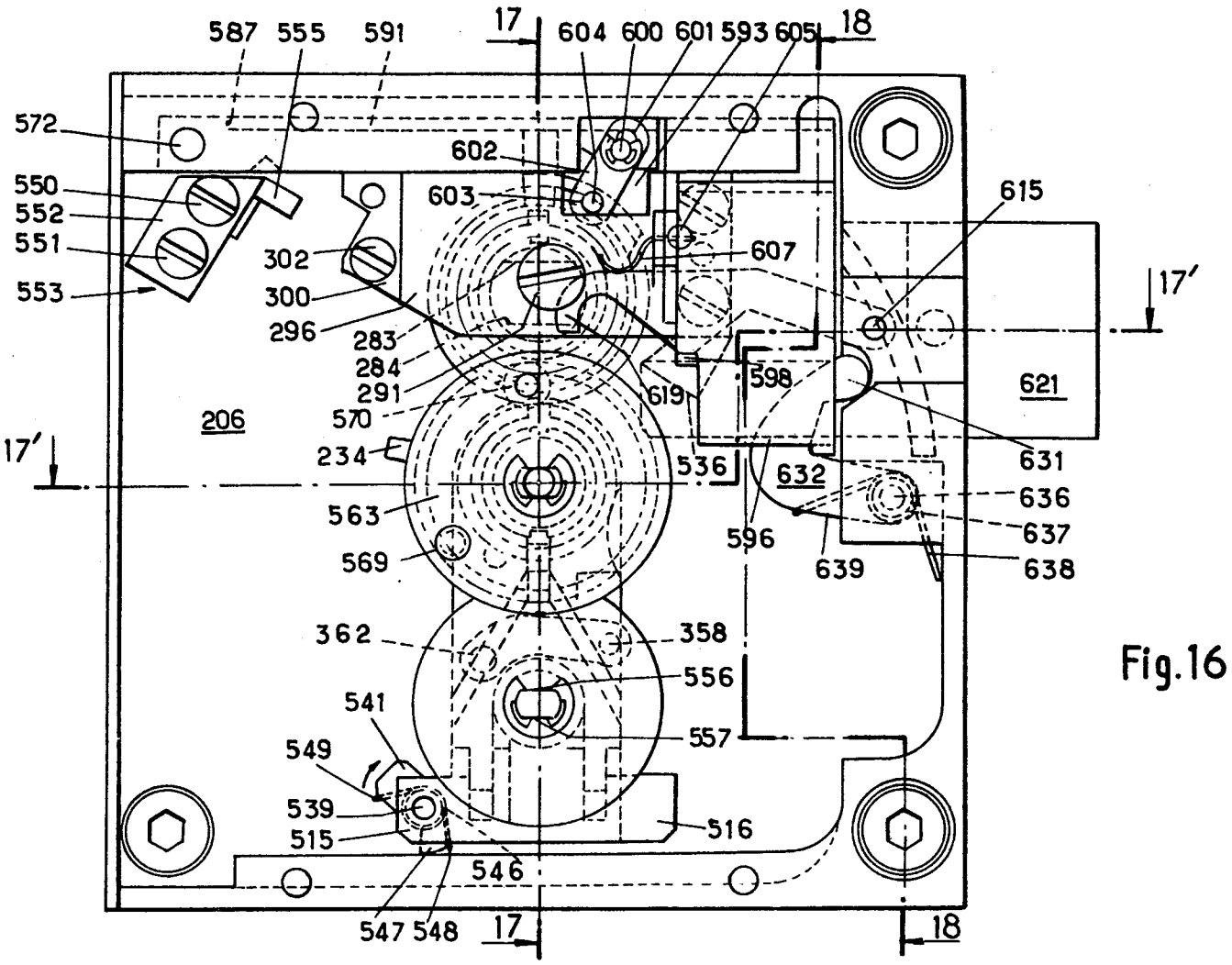
FIG. 16 is a general view from the back of the casing with the lower mechanisms, the back wall having been removed.
Figure 17:
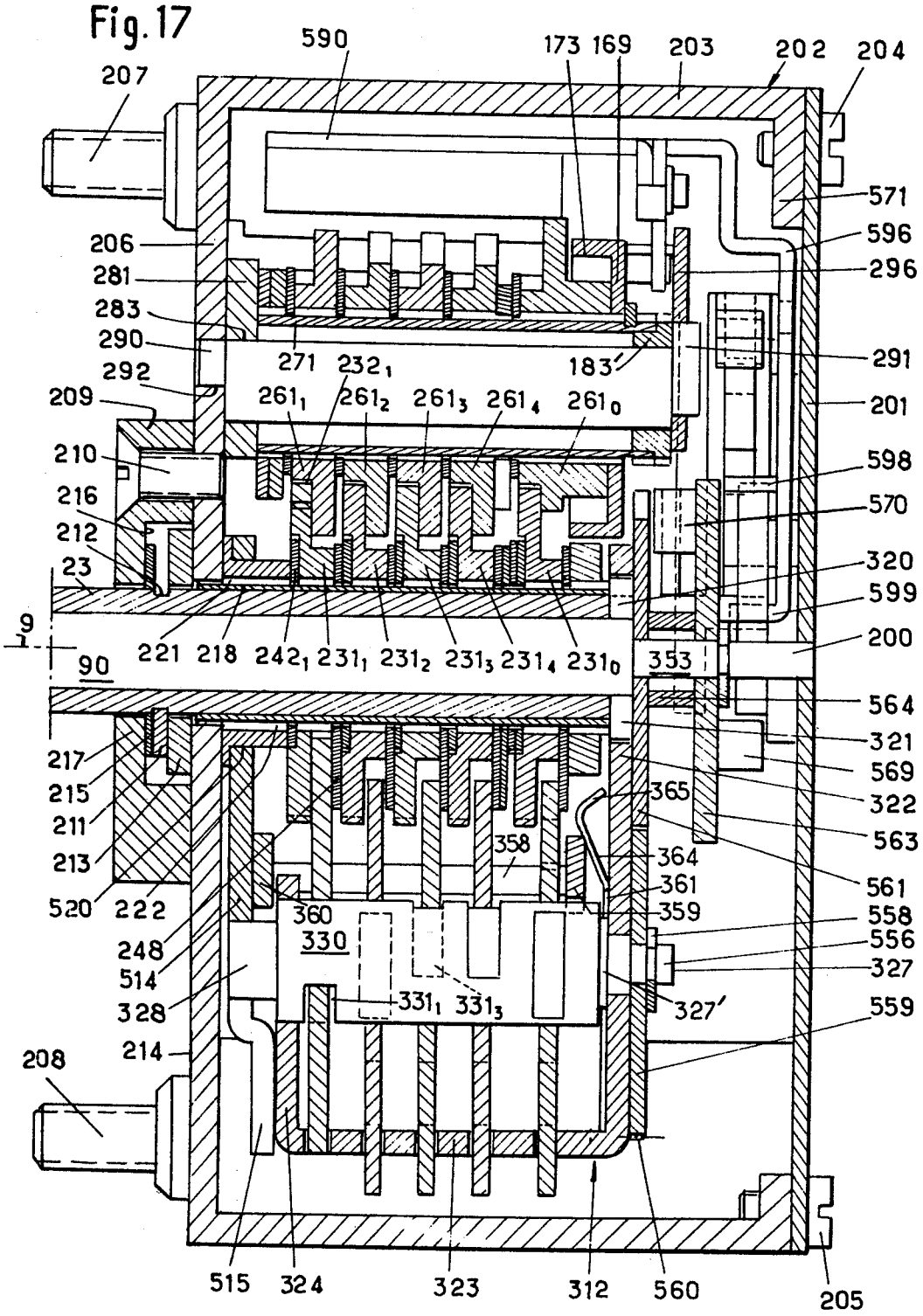
FIG. 17 is a sectional view along line 17—17 of FIG. 16.
Figure 17:
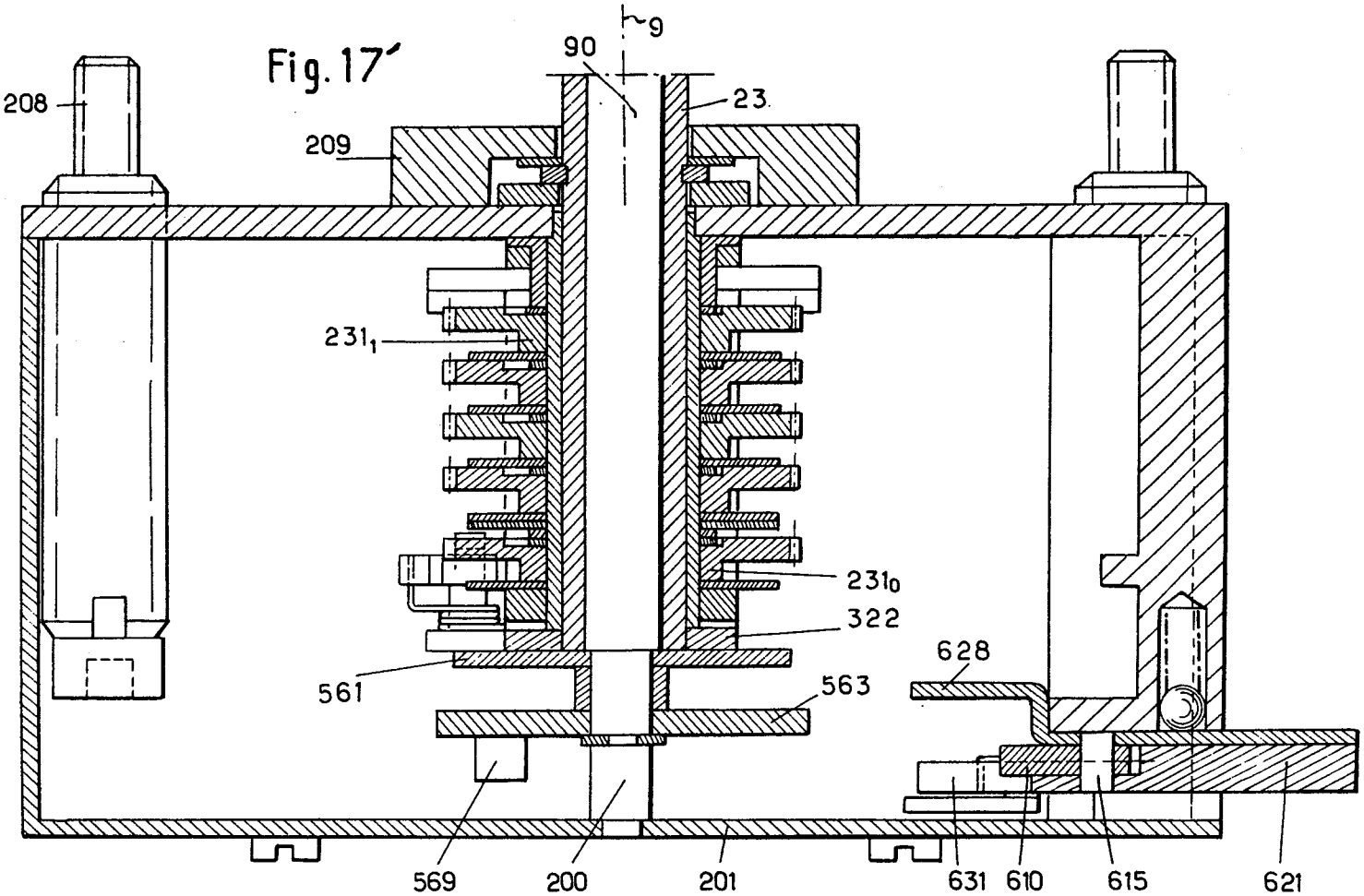
Figure 18:
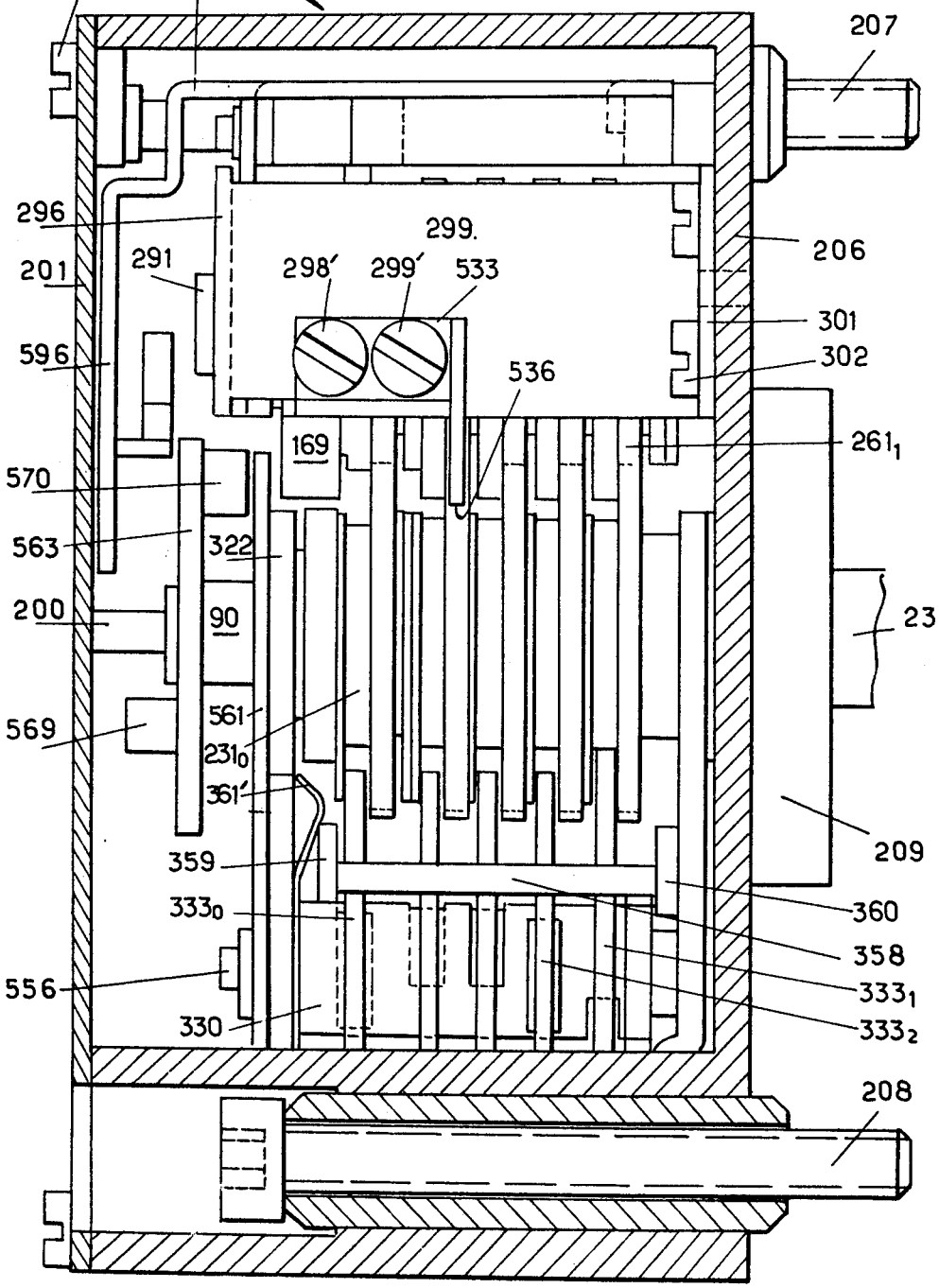
Figure 19:
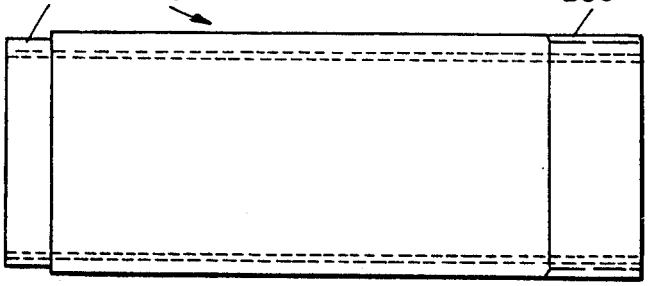
Figure 20:
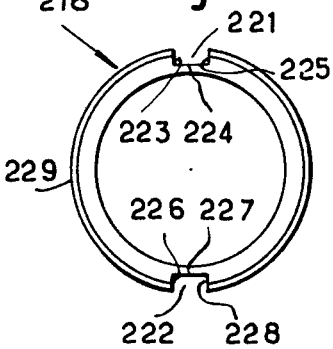
Figure 25:
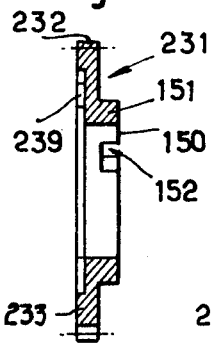
Figure 24:
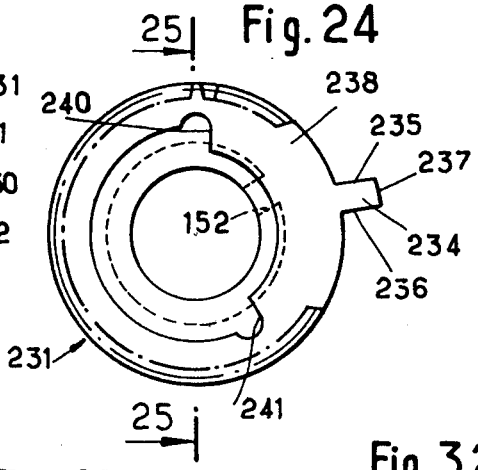
Figure 26:
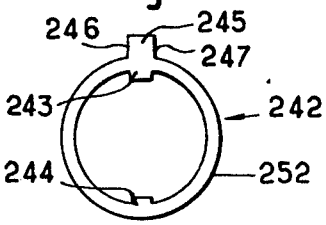
Figure 27:
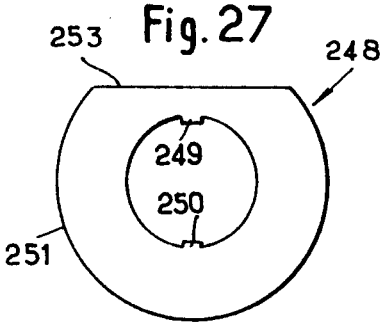
Figure 32:
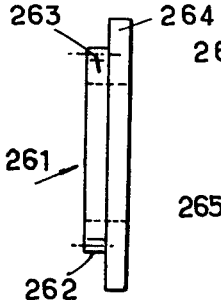
Figure 31:
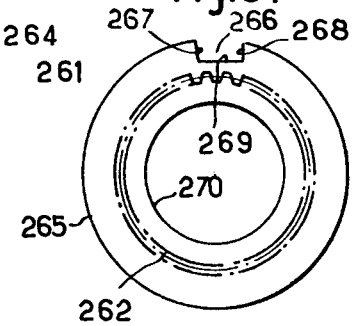
Figure 43:
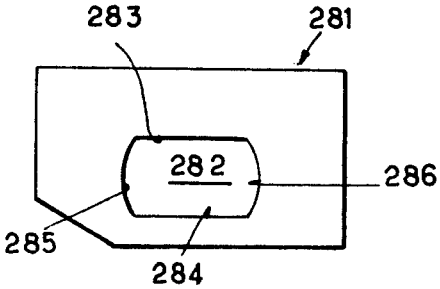
Figure 22:
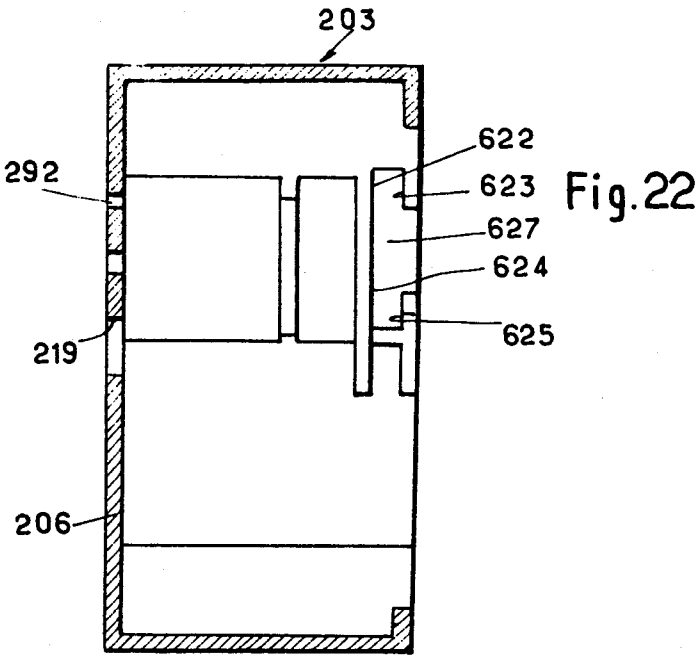
Figure 21:
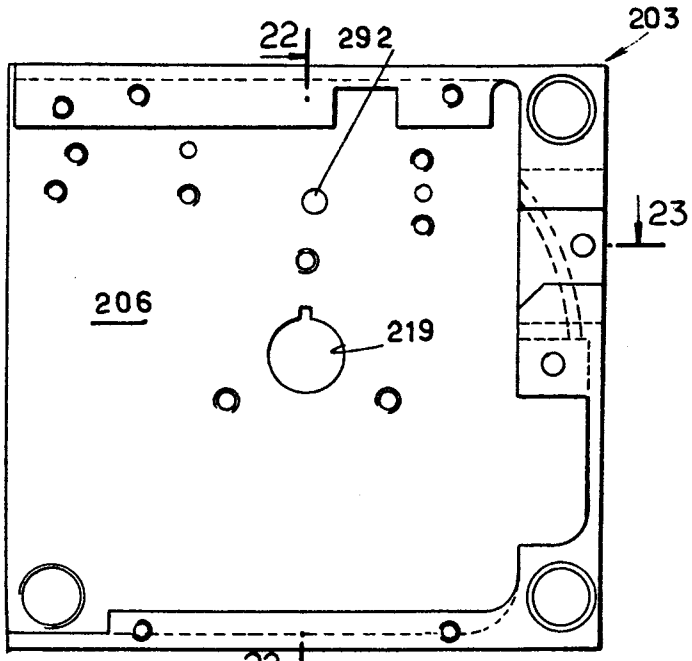
Figure 23:
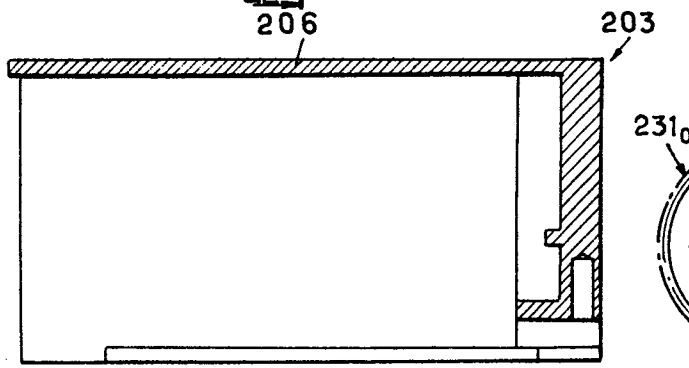
Figure 28:
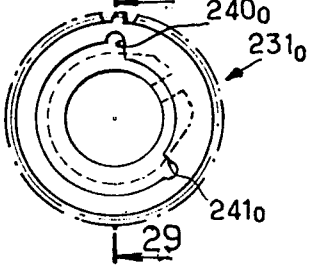
Figure 29:
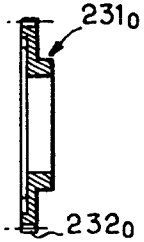
Figure 30:
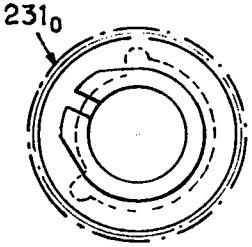
Figure 47:
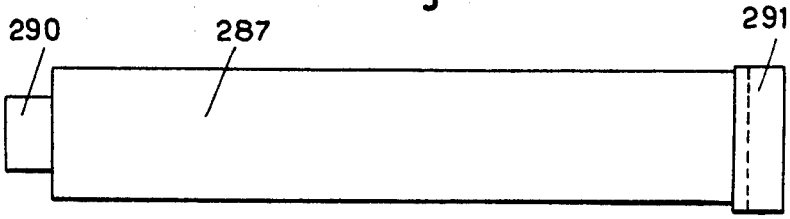
Figure 48:
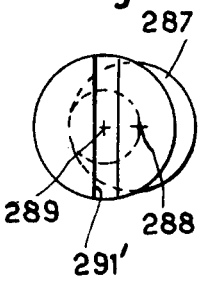
Figure 34:
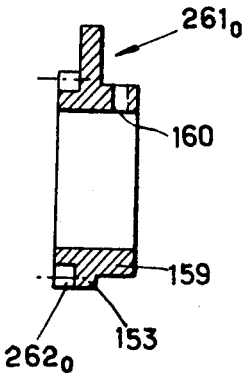
Figure 33:
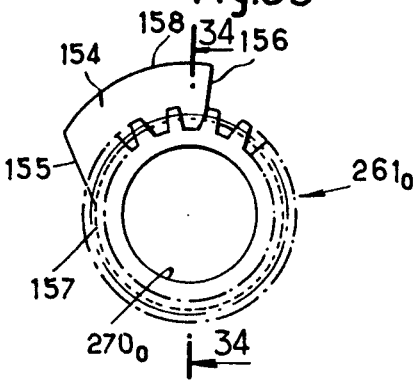
Figure 61:
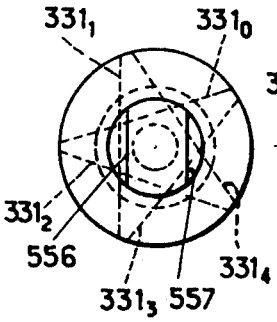
Figure 60:
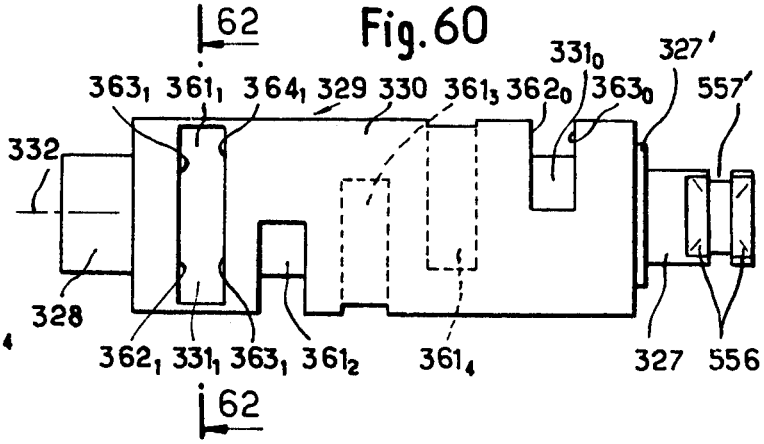
Figure 62:
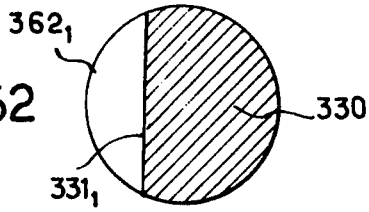
Figure 49:
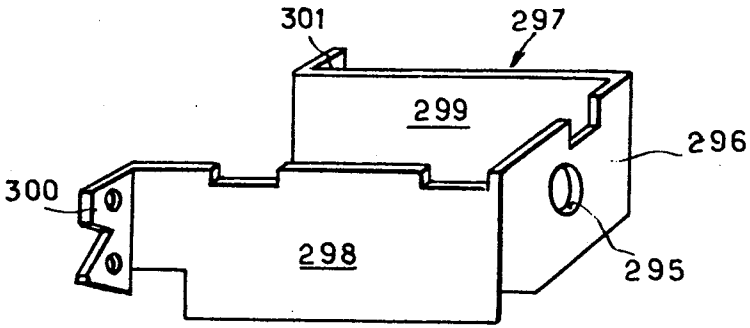
Figure 65:
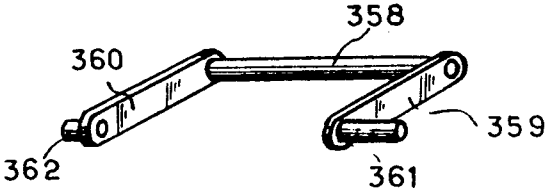
Figure 35:
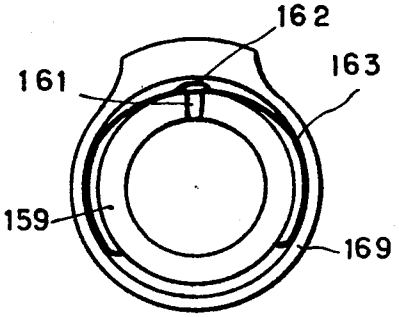
Figure 54:
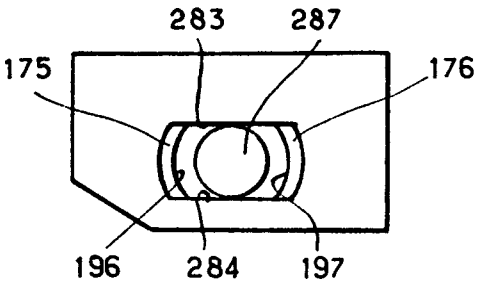
Figures 50, 51, 52, 53, 58, 59:
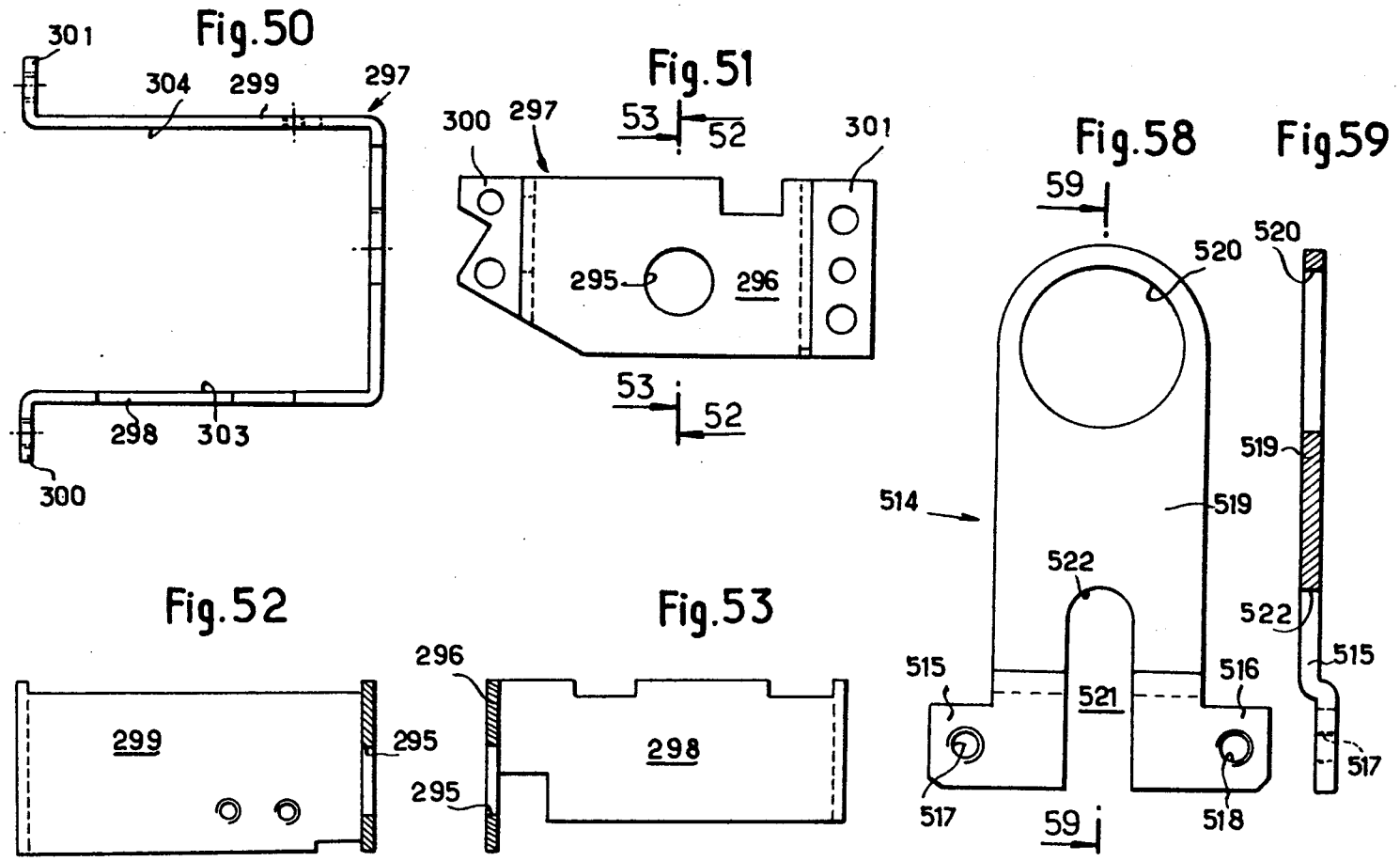
Figures 55, 56, 57, 64:
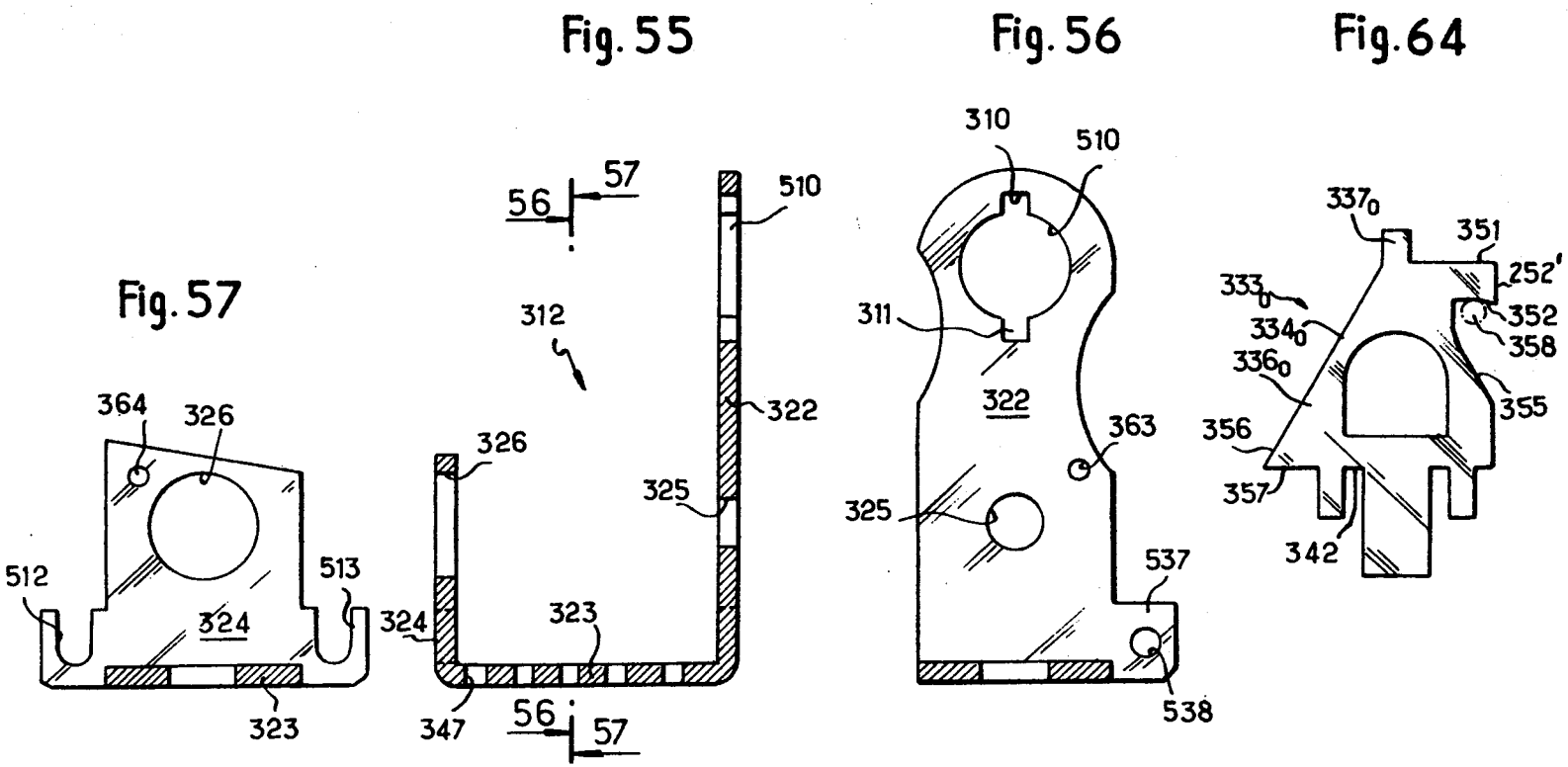
Figure 63:
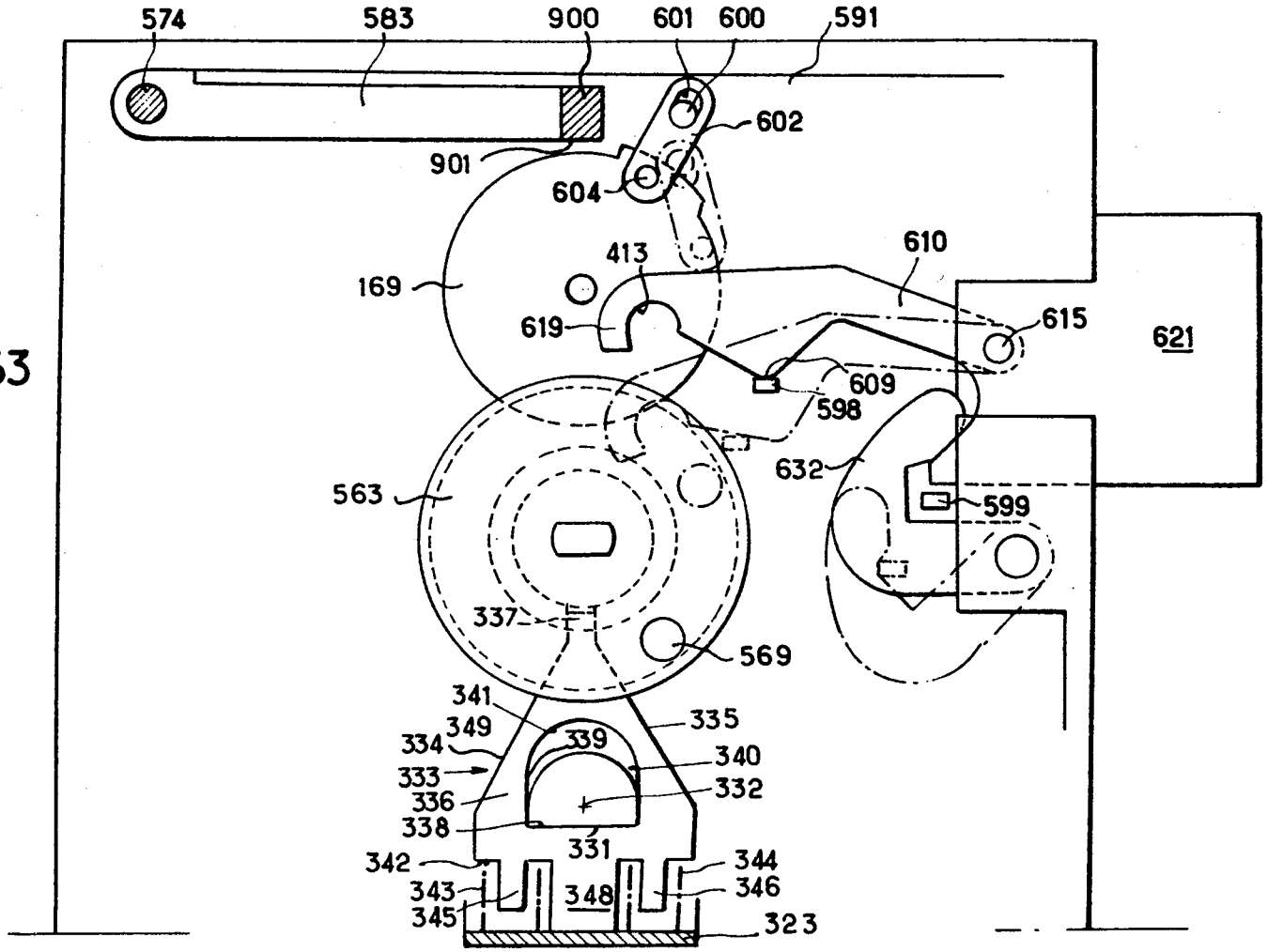
Figure 76:
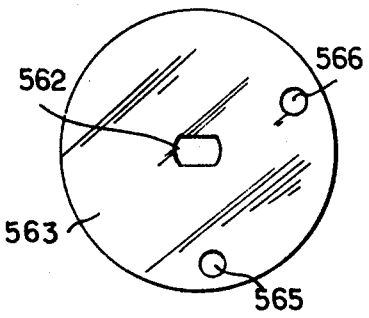
Figure 78:
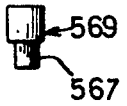
Figure 81:
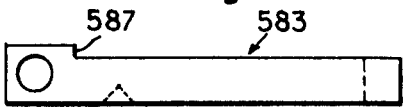
Figure 82:
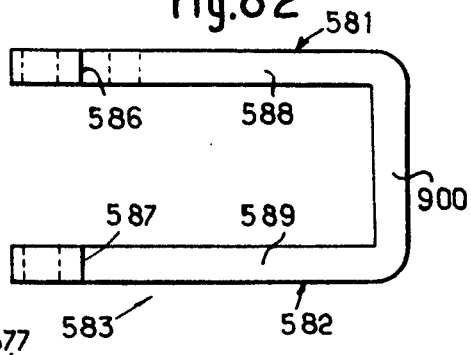
Figure 79:
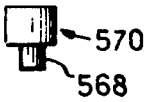
Figure 77:
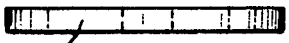
Figure 80:
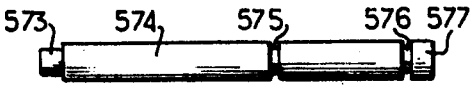
Figure 90:
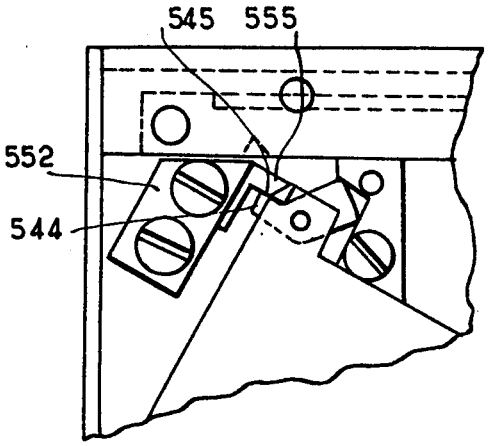
Figure 89:
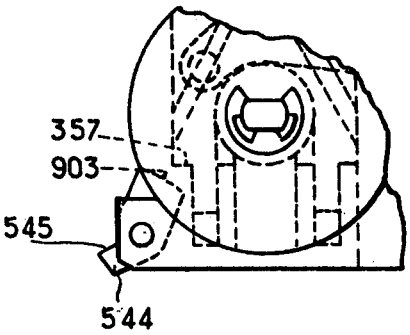
Figure 83:
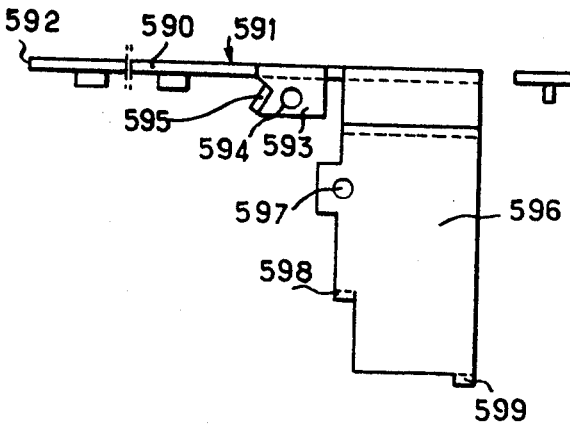
Figure 84:
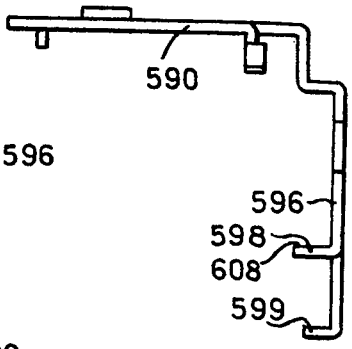
Figure 85:
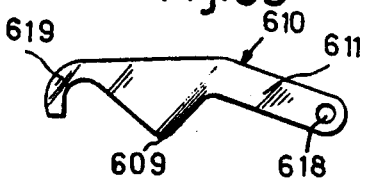
Figure 86:
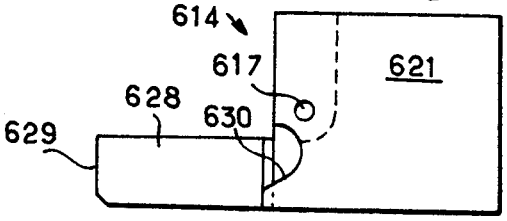
Figure 88:
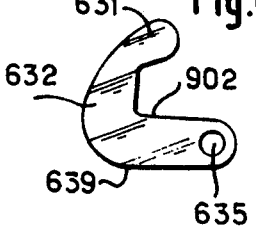
Figure 87:
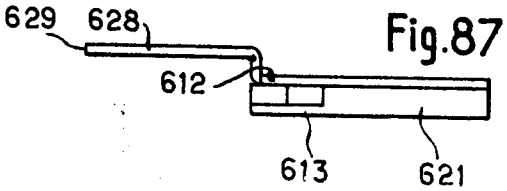

FIG. 17' is a sectional view along line 17'—17' of FIG. 16;

FIG. 18 is a sectional view along line 18—18 of FIG. 16;

FIG. 19 is a view of a pinions' assembly tube;

FIG. 20 is a view at 90° from the preceding one;

FIG. 21 is a view of the casing from the back;

FIG. 22 is a sectional view along line 22—22 of FIG. 21;

FIG. 23 is a sectional view along line 23—23 of FIG. 21;

FIG. 24 is a front view of a display pinion;

FIG. 25 is a sectional view along line 25—25 of FIG. 24;

FIG. 26 is a front view of a ring;

FIG. 27 is a front view of a spacer ring;

FIG. 28 is a front view of a control pinion for the opening of the latch;

FIG. 29 is a sectional view along line 29—29 of FIG. 28;

FIG. 30 is a view similar to FIG. 28, but from the other face;

FIG. 31 is a front view of a locking pinion;

FIG. 32 is a side view of the latter;

FIG. 33 is a front view of a crest bearing pinion;

FIG. 34 is a sectional view along line 34—34 of FIG. 33;

FIG. 35 is a front view of a spring bearing drum;

FIG. 36 is a view of the spring of the drum;

FIG. 37 is a top view of said spring;

FIG. 38 is a view of the drum;

FIG. 39 is a sectional view along line 39—39 of FIG. 38;

FIG. 40 is a side elevational view of an assembly tube for the locking pinions;

FIG. 41 is an end view of the latter;

FIG. 42 is a perspective view of the end of said tube;

FIG. 43 is a front view of an aperture bearing plate;

FIG. 44 is a front view of a cover;

FIG. 45 is a corresponding side view;

FIG. 46 is a sectional view along line 46—46 of FIG. 44;

FIG. 47 is a side elevational view of a cylindrical cam;

FIG. 48 is an end view of the latter;

FIG. 49 is a perspective view of a U-shaped guide part;

FIG. 50 is a top view of the latter;

FIG. 51 is a back view of the latter;

FIG. 52 is a sectional view along line 52—52 of FIG. 51;

FIG. 53 is a sectional view along line 53—53 of FIG. 51 but considered in the direction opposite to the sectional cut of FIG. 52;

FIG. 54 is a front view of the aperture bearing plate with co-operating members;

FIG. 55 is a diametrical sectional view of the wall of a compartment;

FIG. 56 is a sectional view along line 56—56 of FIG. 55;

FIG. 57 is a view along the same sectional cutting line but considered in the opposite direction;

FIG. 58 is a front view of a plate completing the compartment;

FIG. 59 is a sectional view along line 59—59 of FIG. 58;

FIG. 60 is a view of a cylindrical block with counterbores;

FIG. 61 is an end view of the latter;

FIG. 62 is a sectional view along line 62—62 of FIG. 60;

FIG. 63 is a back schematic view of the casing showing the latch operating mechanism;

FIG. 64 is a view of a finger bearing plate;

FIG. 65 is a perspective view of a mixing mechanism;

FIG. 66 is a front view of a spring forming part of the device;

FIG. 67 is a view of said spring, from the edge;

FIG. 68 is a view of a ramp bearing part;

FIG. 69 is a view of said part at 90° from the preceding one;

FIG. 70 is a view of a pawl;

FIG. 71 is a view at 90° from the preceding one;

FIG. 72 is a view of a deflector;

FIG. 73 is a view of said deflector at 90° from the preceding one;

FIG. 74 is a view of a pinion;

FIG. 75 is a sectional view along line 75—75 of FIG. 74;

FIG. 76 is a front view of a disk;

FIG. 77 is a side view of the latter;

FIG. 78 is a view of a pin;

FIG. 79 is a view of another pin;

FIG. 80 is a view of a pivot pin;

FIG. 81 shows the rake in side elevation;

FIG. 82 is a top view of said rake;

FIG. 83 is a view of a rake plate;

FIG. 84 is a view of said plate, but at 90° of FIG. 83;

FIG. 85 is a view of hook bearing arm;

FIG. 86 is a view of the latch;

FIG. 87 is a top view of said latch;

FIG. 88 is a view of a locking pawl;

FIG. 89 is a diagram illustrating the co-operation of the finger bearing plate with a pawl;

FIG. 90 is a diagram illustrating the part of said pawl in another position.

The front wall 1 (FIG. 1) of the safe or strong-box, or of the armoured door, is bored through according to a circular hole 2. Against the front wall 3 is secured the bottom wall 4 of a pan 5 with a flange 6. This one has a rectangular window 7 thereon (FIG. 2) substantially half way up flange 6. From the bottom wall 4 depends a tubular central hub 8, coaxial with the axis 9 of the opening 2 which is the general axis of the operating device.

Figure 3:
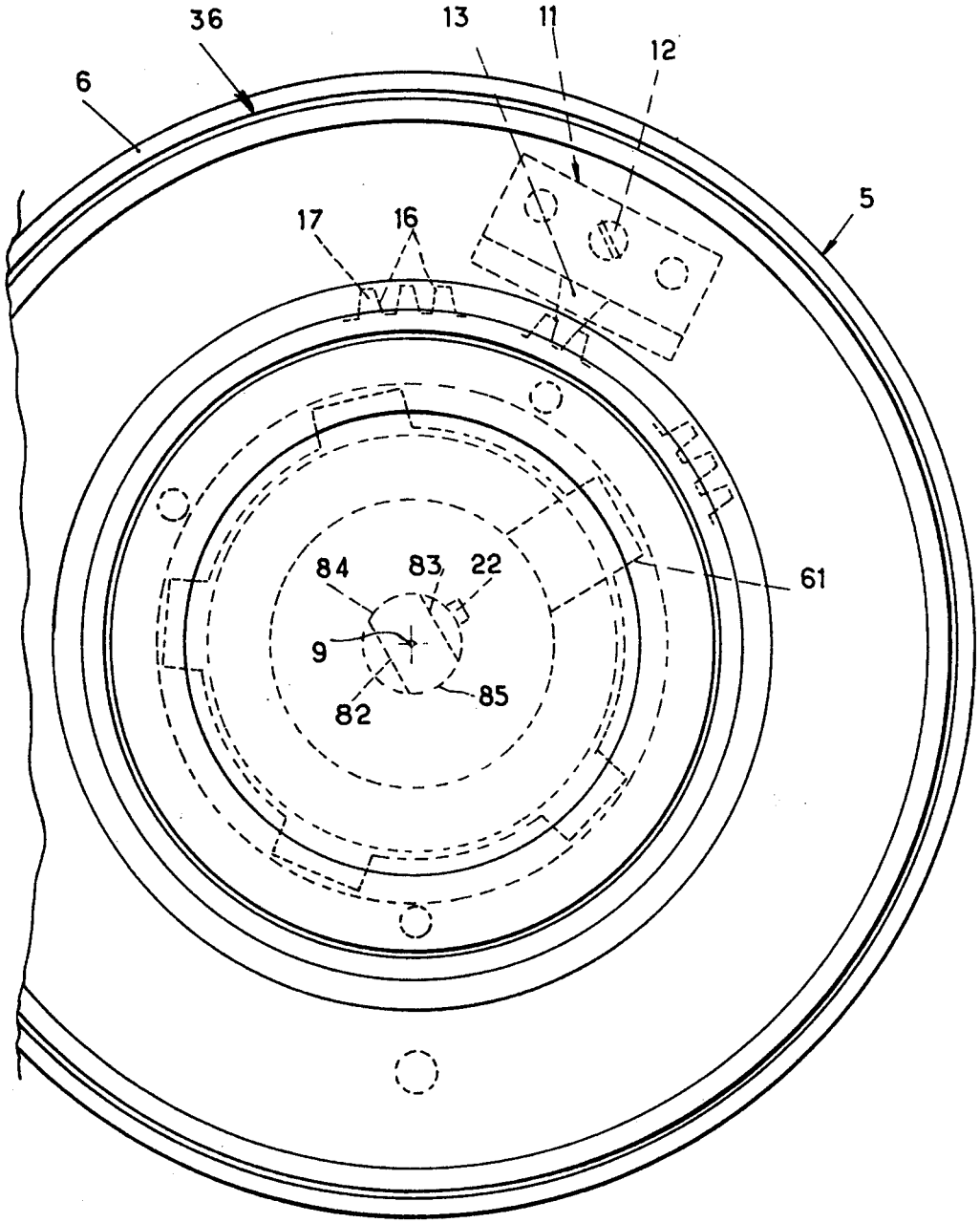
FIG. 3 is a front view of said device.
Figure 5:
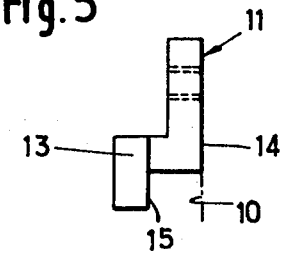
FIG. 5 is a view of said block, also elevational, but at 90° of FIG. 4.
Figure 4:
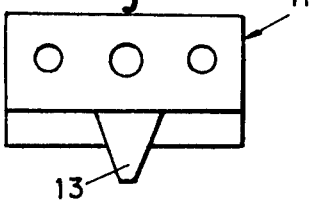
FIG. 4 is a front view of a block which forms part of said device.

On the front face of the bottom wall 4 of the pan 5 is secured by means of a screw 12 (FIG. 3) a parallelepipedic block 11 (FIGS. 4 and 5) the internal face 12 of which, that is the one facing the axis 9, carries a tooth 13. This tooth is at a distance from the back face 14 of block 11, applied against the front face 10 thus leaving a space between the back face 15 of the tooth 13 and the front face 10 of the pan 5.

Figure 7:
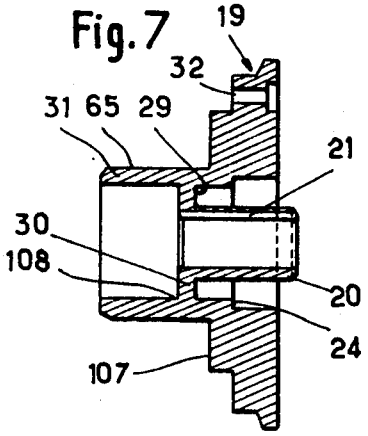
FIG. 7 is a sectional view along line 7—7 of FIG. 6.
Figure 6:
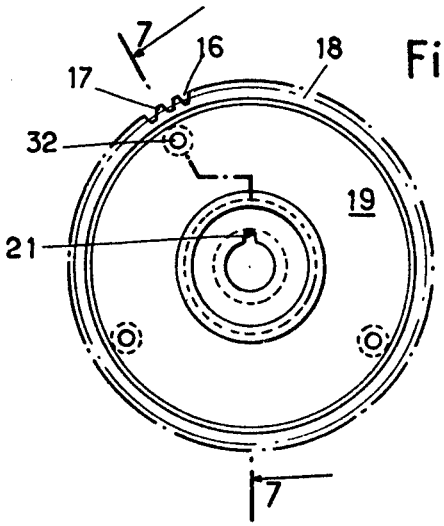
FIG. 6 is a front view of a part co-operating with the display button and with the selector button.

The tooth 13 can co-operate with the spaces 16 extending between the cogs 17 of teeth 18 (FIGS. 6 and 7) formed at the peripheral edge of a ring 19 mounted for rotational movement by means of a barrel 20 inside the hub 8 of the pan 5 and also with a possibility for relative translational movement, parallel to axis 9, of the barrel 20 relatively to the hub 8.

The barrel 20 has a longitudinal internal groove 21 serving to fit a key 22 (FIG. 3) making the ring 19 integral upon rotation with a tubular shaft 23 passing through the wall 1, but giving a possibility for the longitudinal movement to said ring 19 relatively to said tubular shaft 23.

Upon a shoulder 24 of ring 19 bears, by means of a washer 25, a spring 26 bearing on the other hand against a washer 27 applied on the front face 10 of the pan 5.

Figure 1:
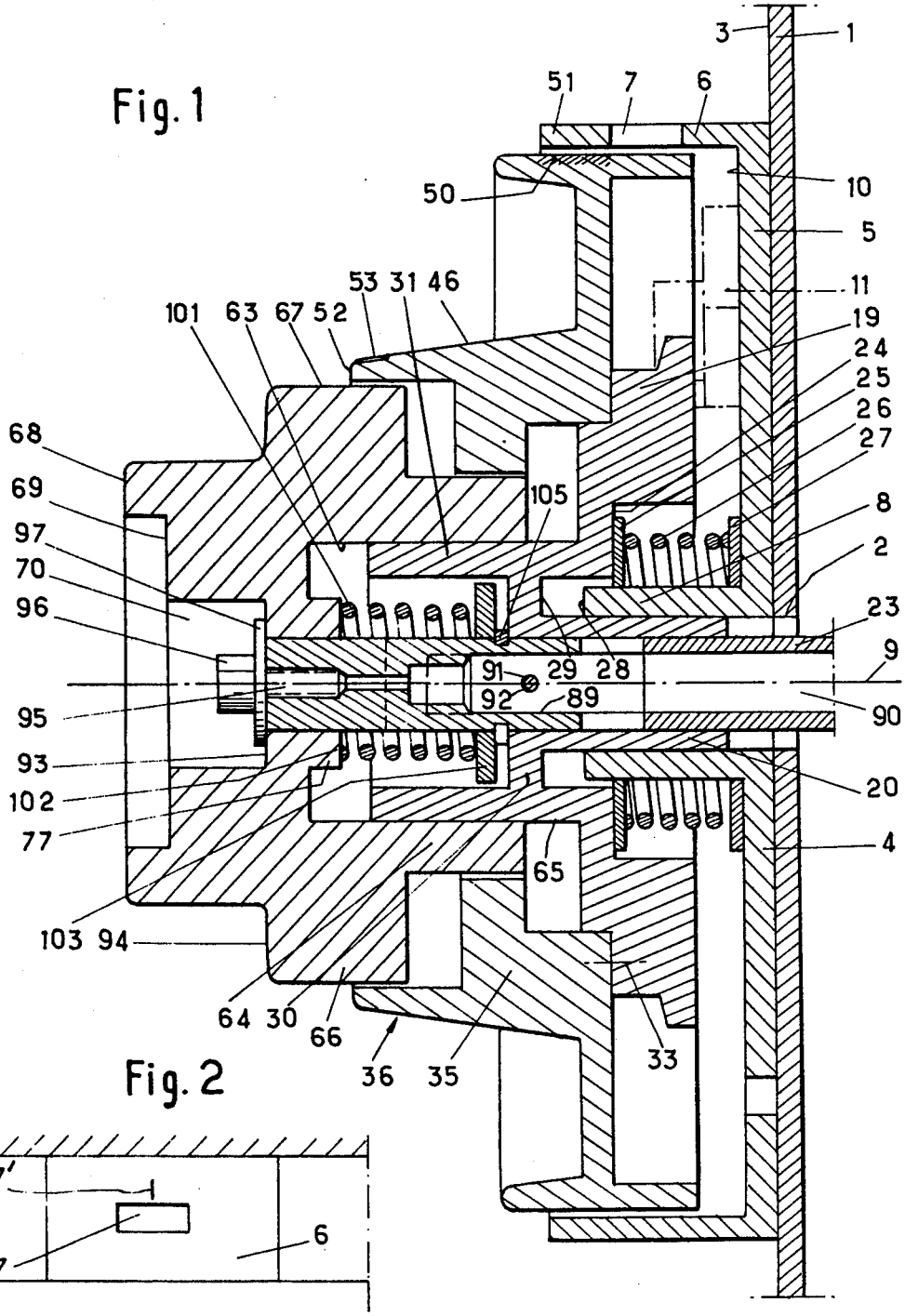
FIG. 1 is a diametrical sectional view of the display button and selector button means.
Figure 2:
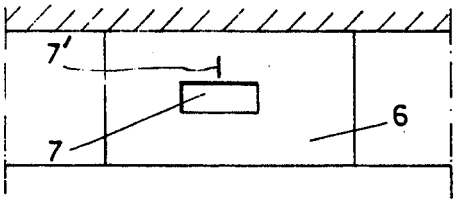
FIG. 2 is a partial top view of said device.
Figure 9:
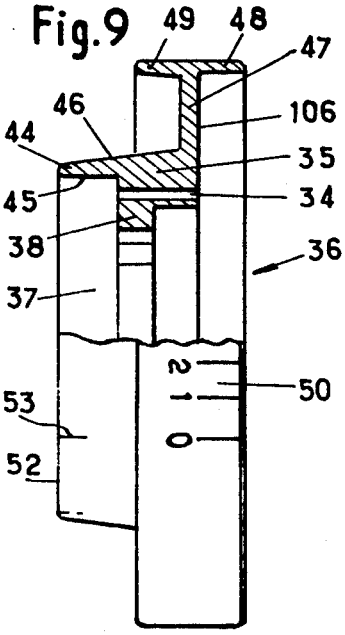
FIG. 9 is a corresponding view of said button, partially sectional, partially elevational.
Figure 8:
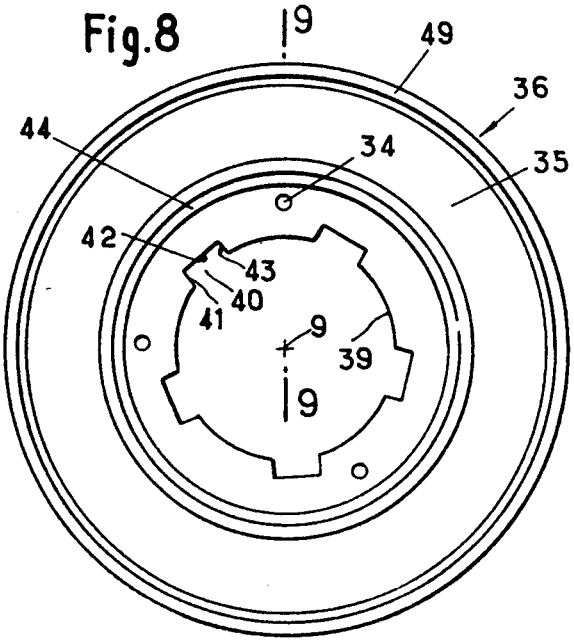
FIG. 8 is a front view of the display button.
Figure 12:
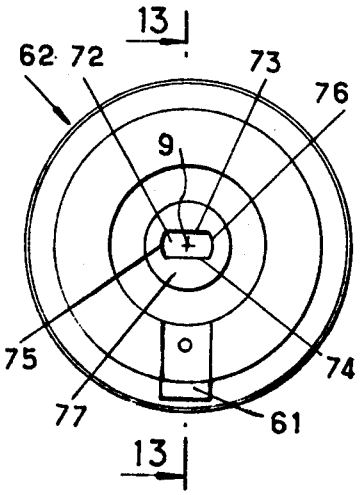
FIG. 12 is a view of said button, but from the other face.
Figure 11:
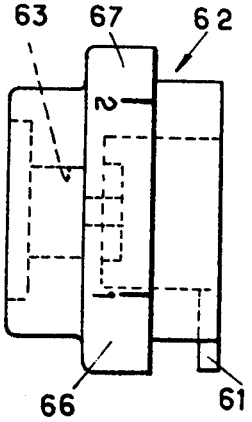
FIG. 11 is an elevational view of the latter.
Figure 10:
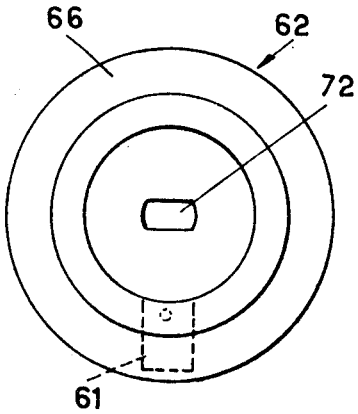
FIG. 10 is a front view of the selector button.
Figure 13:
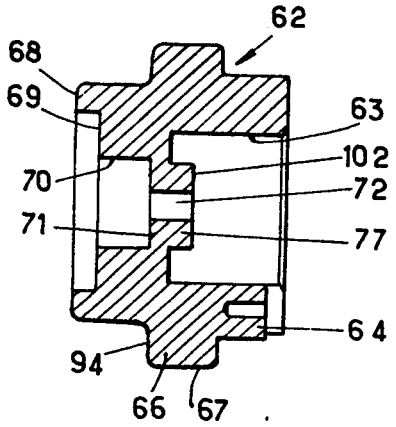
FIG. 13 is a sectional view along line 13—13 of FIG. 12.

In the position shown in FIG. 1, a space is defined between the front cut edge 28 of the hub 8 and the back face 29 of the web 30 of the ring 19 from which depends a skirt 31. Bores 32 pass through the ring 19 and are used to secure it, by means of screws 33 co-operating with internal threadings 34, to the body 35 of a display button 36 (FIGS. 8 and 9). The body 35 is conformed in such manner as to form a pan 37 the bottom wall 38 of which is ring shaped and has an internal edge 39 thereon, of a general circular contour, but which bears rectangular notches 40 with faces 41, 42 and 43, regularly spaced around axis 9, and which are five in number in the example shown.

The edge 44 of the pan 37 is defined by an internal cylindrical surface 45 and by a frusto-conical external surface 46 which meets the web 47, or body of the button, from which depends a cylindrical drum 48. On the external face 49 of this drum are engraved, in the region shown at 50, and circularly spaced in a regular manner about axis 9, the numbers or numerals of a scale, in the example, numbers ranging from 0 to 35. In the position shown in FIG. 1, these numerals are masked by a rim 51, which borders the window 7 of pan 5.

On the frustro-conical surface 46 of the button 36, near the external edge 52, a reference mark 53 is engraved which is in the same diametrical plane as the "O" scale mark on the drum 48.

In order to co-operate with one of the notches 40 on the bottom wall 38 of the pan 37 a finger 61 is provided (FIGS. 10 to 13), of section mating with that of the notches, which forms part of a selector button 62 resting for rotational movement, and also with a possibility for translational movement, by means of the internal surface 63 of its barrel 64, on the external surface 65 of the skirt 31 of the ring 19. The body 66 of the button 62 is cylindrical and is fitted at least in part inside the pan 37 of the display button 36, the external cylindrical surface 67 of the body 66 facing the cylindrical surface 45 of the button 36. On said cylindrical surface 67 are engraved reference marks numbered from 0 to 4 and regularly angularly spaced about axis 9, that is at 72° from each other.

The front face 68 of the button 62 is formed with a first recess 69, and with a second recess 70, of smaller diameter the bottom wall 71 of which defines a passage 72 of substantially rectangular cross-section, with parallel planar faces 73 and 74, the other faces 75 and 76 being however cylindrical and coaxial with axis 9. The bottom wall 71 has on its back face an annular boss 77.

Figure 14:
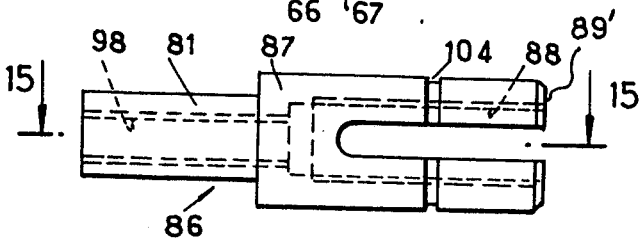
FIG. 14 is a view of an assembly part of the button device.
Figure 15:
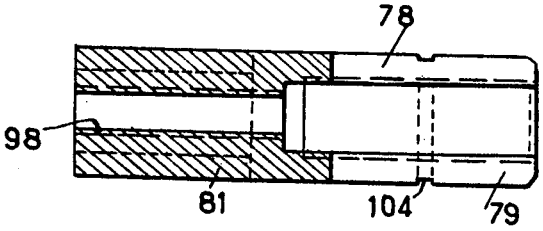
FIG. 15 is a sectional view, along line 15—15 of FIG. 14.

Inside of passage 72 is fitted a head 81 (FIGS. 14 and 15), with quasi-rectangular mating cross-section, with parallel planar faces 82 and 83 (FIG. 3) and cylindrical faces 84 and 85, of a connector 86 the cylindrical body of which 87 is internally formed with an internally threaded bore 88 opening on the face 89' opposite head 81. The tubular body 87 has thereon two traversing longitudinal diametrically opposed grooves 78 and 79.

With the internally threaded bore 88 co-operates the threaded end 89 of a shaft 90 (FIG. 1) passing through wall 1 and pierced through with a diametrical hole 91 for the passage of a pin 92 inserted when, by co-operation of the threading on the axle 90 and of the threading on the bore 88, the bottom wall 71 of the recess 70, which is in the same transverse plane as the front face 94 of the body 66 of the button 62, is at a predetermined distance from the front face 3 of wall 1.

A spring 101 bears, on one hand on the back face 102 of the boss 77 and on the other hand on a washer 103 inserted around the body 87 of the connector 86, this latter having a circular groove 104 therearound in which is fitted a circlip 105.

The position represented in FIG. 1 is that for which the buttons 36 and 62 are secured against rotational movement. In this condition, indeed, the tooth 13 of block 11 is in engagement with the teeth 18 on ring 19. To release the teeth 18, the display button 36 is depressed towards the wall 1; the thrust exerted against the action of the spring 26, is transmitted by co-operation of the surface 106 of web 47 with the surface 107 of the ring 19. The opposing faces of the space existing between cogs of the teeth 18 in which was fitted the tooth 13 move along the latter until the teeth 18 are on their whole thickenss nearer from the bottom wall 4 than the tooth 13. It is then possible to cause the display button 36 to turn about axis 9. During this rotation, the numerals marked on the region 50 of the drum 48, masked until then by the rim 51, pass before the window 7. During this rotational movement, to which partakes the ring 19 made solid with the display button 36 by means of the screws 33, the tubular shaft 23 is caused to rotate by co-operation of the key 22 connecting it with the barrel 20.

To this rotational movement also partakes the selector button 62 and this because of the engagement of the tooth 61 of the selector button in a notch 40 of the display button 36, as well as the axle 90 made solid with the connector 86 by means of the pin 92, said connector having its rectangular head 81 fitted inside of the rectangular recess 72 in the selector button 62.

The rotation of the display button 36 is continued until the desired reading of the scale carried by the region 50 appears through the window 7. If the display button 36 is released when said reference mark is exactly opposite a reference mark 7' drawn from a transverse border of the window 7, this latter returns to its initial position under the action of the spring 26, because then, a new space existing between cogs of the teeth 18 of the ring 19 is, for this position, reached by the display button 36 in face of the tooth 13; the translational movement of the button 36 under the action of the spring 26 can thus be effected until the face 108 of the web 30 of the ring 19 comes again into engagement with the circlip 105; the new space existing between cogs of the teeth 18 engages tooth 13 on block 11, which is fixed.

If, starting from the position shown in FIG. 1, in which the buttons 36 and 62 are secured against rotational movement, the selector button 62 is depressed against the action of the spring 101, the tooth 61 of the selector button is released from the notch 40 into which it was fitted, and, for a sufficient depression of the button 62, it becomes possible to cause the selector button 62 to rotate. During this phase, the display button 36 is not driven, being kept fixed by co-operation of the teeth 18 of the ring 19 with the tooth 13 on block 11.

After having caused the button 62 to rotate a fifth of a turn or a multiple of this angle, the tooth 61 is in face of another notch 40, so that, by releasing the thrust, the tooth 61 can engage this notch and the condition of the device becomes once more that shown in FIG. 1.

The angular position of the selector button 62 relatively to the display button 36 is identified by considering the scale mark carried by the cylindrical surface 67 of the selector button registering with the reference mark 53 carried by the display button 36.

During the rotation of the selector button 62, the shaft 90 is driven but the display button 36 is not driven by the fact that the tooth 61 is then disengaged from the notch 40 into which it was initially fitted.

If, after having released the display button 36, the position reached is not one of those provided for the operation, which happens if, inadvertantly, the display button 36 is released in a position for which the scale mark it carries does not exactly register with the reference mark 7', then there are no spaces existing between cogs in the teeth 18 exactly opposite the tooth 13 and the display button does not move completely longitudinally to take on, again, along the tubular shaft 23, its initial position. If afterwards, when the selector button 62 is operated, the latter is depressed, the longitudinal displacement of said button 62 does not enable the tooth 61 to be released from the notch 40 in the display button 36 into which it is fitted and it is not possible to turn the selector button 62. The operator is thus informed of the inexact angular position of the display button 36. After this latter has been corrected and the display button has taken on again its position shown in FIG. 1, it becomes again possible to depress the selector button 62 up to a position where its rotation can be effected.

If after having caused the selector button 62 to rotate, it is released in a position for which the finger 61 is not exactly registering with a notch 40, then, when the selector button 62 is released, it does not take on again its projecting position. If, not perceiving this anomaly, the operator then depresses the display button 36 in view of its rotation, during this depression a non notched portion of the back face of the bottom wall 38 comes into abutment with the finger 61, thus driving the selector button 62 in an axial movement which brings it in abutment by its face 102 with the joining shoulder formed between the body of the connector 86 and the head 81 of the latter. For that position, the displacement of the display button 36 has not been sufficient for its teeth 18 to be completely released from the tooth 13 so that, after this depression, it will be possible to rotate the display button 36.

The shaft 90 which is integral with the selector button 62 rests at its end 200 in the back cover 201 of a mechanisms' casing 202 (FIGS. 16 and 18) with body 203 onto which the cover 201 is secured by means of screws 204 and 205. The front wall 206 of the body 203 bears securing devices 207 and 208 enabling to secure it to the door of the safe or the like. Onto the wall 206 is secured a cylindrical fore casing 209 by means of screws 210.

The tubular shaft 23, connected with the display button 36, is secured against longitudinal movement by means of an annular ring 211 fitted into a groove 212 formed on said shaft and co-operating, on one hand with a small plate 213 in abutment engagement with the front face 214 of the wall 206 and on the other hand, through a washer 215, against the back surface 216 of the front wall 217 of the fore casing 209.

A tube 218 (FIGS. 19 and 20) inside which the tubular shaft 23 can rotate is inserted by its end 220, inside a circular opening 219 (FIGS. 21 to 23) provided in the wall 206 of the casing 203. Said tube has thereon two diametrically opposed grooves 221 and 222, which are straight, extend the whole length of the tube, and have rectangular cross-section defines by faces 223, 224, 225 and 226, 227, 228 respectively. At its end opposite end 220, the tube 218 is formed with a threading 230.

Onto the external surface 229 of said tube, display control pinions are mounted for rotational movement, four in number in the example shown, $231_1$, $231_2$, $231_3$, $231_4$. Each one of pinions 231 (FIGS. 24 and 25) has teeth 232 formed at the peripheral edge of the flange 233 thereof. From each flange 233 depends a radial ear 234, defined by straight sides 235 and 236 and by an end edge 237, the ear being formed on a portion 238 of the flange which is deprived of cogs. On its back face 150 the body 151 of the pinion 231 has a notch 152 with rectangular contour.

On an angular distance of about 150°, the flange 233 is formed with a recess 239 defining thus abutment faces 240 and 241, the angle defined by the abutment face 240 and the axis of the tooth 234 having a determined value as explained further.

Inside each flange 233, in the corresponding recess 239, is fitted a ring 242 (FIG. 26) having diametrically opposed internal lugs 243 and 244 adapted to co-operate with the grooves 221 and 222 of the tube 218 and an external lug 245, in face of lug 243, adapted to act as fixed stopping means, through its sides 246 and 247, by co-operating with the abutment face 241 and with the abutment face 240 respectively during rotational movement of the pinion 231, inside the recess 239 of which said ring is fitted.

Spacer rings 248 (FIG. 27) are placed adjacent rings 242 respectively. They bear diametrically opposed internal lugs 249 and 250 co-operating with the grooves 221 and 222. The external circular edge 251 of a spacer ring 248 has a larger diameter than the circular edge 252 of the rings 242, but they are cut according to a straight edge 253.

Onto the external cylindrical face 229 of tube 218 is further mounted a fifth pinion $\mathbf{231_0}$ (FIGS. 28 to 30) the constitution of which is similar to that of pinions $\mathbf{231_1}$—$\mathbf{231_4}$ with the exception that the pinion $\mathbf{231_0}$ does not have any radial ear and that the angular distance between the abutment faces $\mathbf{240_0}$ and $\mathbf{241_0}$ is different from that which separates the angular faces 240 and 241 of the pinions $\mathbf{231_1}$ to $\mathbf{231_4}$ or current pinions. In the example, if the angular distance between the faces 240 and 241 of the current pinions 231 is of 150°, the distance between the corresponding faces of the pinion $\mathbf{231_0}$ is of 135°.

With the teeth 232 of each one of the display control pinions $\mathbf{231_1}$ to $\mathbf{231_4}$ mesh the teeth 262 (FIGS. 31 and 32) of a locking pinion $\mathbf{261_1}$, $\mathbf{261_2}$, $\mathbf{261_3}$, $\mathbf{261_4}$ respectively. The teeth 262 are formed at the peripheral edge of a flange 263. On the peripheral edge 265 of a flange 264 of greater diameter, a notch or passage with rectangular cross-section is formed, defined by edges 267, 268, 269.

With the teeth $\mathbf{232_0}$ of the pinion $\mathbf{231_0}$ mesh teeth $\mathbf{262_0}$ of the fifth pinion $\mathbf{261_0}$ (FIGS. 33 and 34) coaxial with the locking pinions 261. The greater diameter flange 153 of said pinion presents a crest 154 with straight edges 155 and 156 merging with the cylindrical surface 157 of the flange 153, the external border 158 of the crest 154 being cylindrical and coaxial with the surface 157. The pinion $\mathbf{261_0}$ has thereon a back flange 159 bored through with a radial hole 160.

Into the hole 160 is inserted a nail 161 (FIG. 35) the head 162 whereof serves to secure a blade spring 163 (FIGS. 36 and 37) having the shape of a basket handle, the body of which 164 is punched through with a hole 165 for the passage of the nail 161, and the curved arms 166 and 167 of which co-operate with an internal cylindrical surface 168 of a drum 169 (FIGS. 38 and 39) the bottom wall 170 of which has a circular opening 171 therein. A hole 172, parallel to the axis of the drum, extends through the bottom wall 170 and forms a notch in the side wall 173 of the drum.

The pinions $\mathbf{261_1}$–$\mathbf{261_4}$ and $\mathbf{261_0}$ are mounted for rotational movement through their internal circular surfaces $\mathbf{270_1}$–$\mathbf{270_4}$ and $\mathbf{270_0}$, onto a tube 271 (FIGS. 40 to 42). The tube 271 has a body 174 which terminates at one of its ends by two diametrically opposed lugs 175 and 176 which are defined by two opposed planar faces 177, 178 and 179, 180 respectively, the cylindrical joining surfaces between said faces being referenced by the numerals 181 and 182. The tube 271 has thereon, intermediate its length, a first circumferential groove 183 and a second circumferential groove 184, both with rectangular cross-section. The tube 271 has also thereon two diametrically opposed longitudinally extending grooves 272 and 273.

The tube 271 is fitted by means of its lugs 175 and 176 into an inside aperture 282 (FIG. 43), with two parallel sides 283 and 284 joined by two circular sides 285 and 286, which is formed in a plate 281 adjacent wall 206.

At the end of the tube 271 opposite lugs 175 and 176 is fitted a tubular cover 183' (FIGS. 44 to 46) which, of a general ring shape, comprises a disk shaped body 184' through bored with a channel 185 defined by two opposed cylindrical surfaces 186 and 187 and by two planar surfaces 188 and 189, the channel 185 having thus a substantially rectangular shape. From the front face 190 of the disk 184' depend two diametrically opposed lugs 191 and 192, the internal surfaces 193 and 194 of which prolong the surfaces 188 and 189 and the external surfaces of which 195 and 196 are cylindrical and have the same diameter as the cylindrical surfaces 186 and 187. Diametrically opposed notches with rectangular cross-section 195' and 196' are provided on the lateral surface of the disk shaped body 184'.

In the space left free, on one hand between the straight edges 283 and 284 of the aperture 282 (FIG. 43) and on the other hand betwen the internal cylindrical faces 196 and 197 of the lugs 175 and 176 depending from the tube 271, is mounted the end 290 of a cylindrical cam body 287 (FIGS. 47 to 49). At its opposite end 291, the cylindrical cam body 287 is mounted in a seating defined on one hand by the planar faces 193–188, 189–194, and on the other hand by the cylindrical surfaces 186 and 187 of the cover 183', the distance between the faces 188–193 and 189–194 being equal to the diameter of the body 287, itself being equal to the distance which separates the edges 283 and 284 of the aperture 282.

The axis 288 of the cam body 287 is displaced relatively to the common axis 189 of the two end cylindrical bearing surfaces 290 and 291, of differing diameters, extending on both sides the cam body 287.

The bearing surface 290 is mounted for rotational movement inside a corresponding hole 292 (FIGS. 17 and 21) of the wall 206 of the body 203 of the casing 202. The bearing surface 291 comprising on its frontal end face a straight diametrically extending slot or groove 291' passes through a circular passage 295, of correpsonding diameter, which is provided in the body 296 of a part 297, having a general U-shape (FIGS. 49 to 53). During rotation of the cam 287 about axis 289, the co-operation of the cylindrical body of the cam body 287 with planar lugs 188 and 189 on one hand and on the other hand with edges 283 and 284 causes said plate 281 and said cover 183 which is integral with tube 171 to move translationally away or towards the axis 9. The parallel arms 298 and 299 of the part 297 are terminated with flanges 300 and 301 adapted to secure it onto the wall 206 of the casing by means of screws such as 302. It is the opposing faces 303 and 304 of the arms 298 and 299 which serve to guide for sliding movement the plate 281 in its movement away or towards the axis 9, common to the shaft 90 and to the tubular shaft 23.

A movement of the plate 281 away from the axis 9 displaces the teeth of the pinions 261, which the tube 271 carries, away from the teeth 232 of the pinions 231 and a movement towards said axis causes again the teeth of the two groups of pinions to engage one another.

Solid with the tubular shaft 23 are two keys 320 and 321 (FIG. 17) which are inserted into corresponding be informed that it is first required to bring back the display and driving button 36 to the position "0" to be able to effect a new opening. In this position, indeed, the part 555 integral with the bottom wall 206 of the casing, exerts its action against the face 545 of the catch 544 of the lever 541 and causes this latter to rotate about its axle 539 up to the position shown in FIG. 90. The interdiction lever 541 does not prevent any longer the finger bearing plate $333_0$ from moving, and said plate can take on again its position away from the axis and thereby makes possible the further driving of the selector button from the position "0" to the position "1" for the realisation of a new displaying in view of the opening of the safe.

In order to change the combination, that is to change from a four number combination to a new combination of four numbers, the following procedure must be carried out.

The lock being prepared for a first combination, this latter is displayed by successive activations of the display button 36 and the door is opened by a complementary action of the display button. The lock latch 614 being retracted, the door is opened and the inside of the lock can thus be accessed to. The selector button 62 is in the "0" position. The display button 36 is in abutment corresponding to the retraction of the latch. Through operation of the display/driving button 36, an anticlockwise direction, by bringing it up to abutment "0", the coming out of the latch is effected as seen hereinabove. The old combination is displayed anew, by displaying successively the first number, the second number, etc. The selector button 62 is brought to the "0" position as if it was desired to effect a new opening. The display button 36 is brought back to the "0" position. The display button 36 is taken up again and is brought to a position marked C for which the crest 154 of the pinion $261_0$ which prevented, in the "0" position of the display button 36 the lowering of the rake 583 inside the passage 266, is no longer opposite the bar 900 of said rake. By means of an operation which is carried out with an ad hoc tool, the cam 287 is caused to rotate to such effect that, by co-operation with the openings 270 inside the pinions 261, said pinions are moved away from the axis 9 enough for their teeth 262 to come out of engagement with the teeth 232 of the pinions 231 and for the notches 152 of said pinions to come into engagement along their sides with the rake bar 583. The display button 36 is then depressed. It is caused to rotate in the clockwise direction up to abutment. At the end of its run, the bar 358 of the mixer, carried by the arms 359 and 361, comes into contact with the different pinions 231. The display button 36 is depressed anew and is rotated in an anticlockwise direction up to the "0" position. During this rotation, the bar 358 of the mixer, by passing along the peripheral edges of the pinions 231, brings back to the "0" position the tabs 237 on said pinions.

If for instance, for the new combination, it is desired to display 5 on the first counter, the selector button 62 is brought into the position "1", the display button is taken up and "5" is displayed on the display button. The same operation is carried out for each one of the other counters and thus a new combination has been displayed, of which trace is taken. After the display of the last number, the selector button 62 is brought back to the "0" position. The display button 36 is depressed and is rotated until it is in the "0" position. The display button 36 is taken up again and, by means of a rotation in the clockwise direction, it is brought before the reference mark C. The device is reclutched by means of a rotation in the reverse direction of the cylinder 287. The lock is adapted to be opened by means of the formation of the new combination.

What I claim:

1. A combination lock for controlling the motion of a lock latch, comprising:

(a) A plurality of components having notches formed therein, each displacable as a function of a numeral in the combination so that, upon display of the right combination, the notches are aligned to permit actuation of means for retraction of said latch;

(b) first means actuatable selectively to displace any one of said components to a position corresponding to a particular numeral in said combination and to provide an indiation of said position;

(c) second means actuatable to determine which of said components is to be displacable by actuation of said first means;

(d) a rake actuated by said first means for engaging said notches when there are aligned to permit actuation of means for retracting said latch, said rake being held at a distance from said notched components during the displacement thereof; and (e) a frictional coupling means between said first means and said rake for limiting the force exerted on said rake by said first means.

2. A lock according to claim 1 including a hooked arm pivoted on said latch and a driving pin actuatable by said first means for retracting said latch, and wherein said rake comprises a first support surface adapted to maintain said hooked arm out of engagement with said driving pin until said notches are aligned.

3. A lock according to claim 1 including a retaining catch for said latch pivotably mounted in said lock and controlled by said rake so that when said rake is not engaged in said notches, said retaining catch maintains said latch in its locking position, and a pin mounted on said rake for driving said retaining catch out of engagement with said latch when said rake is engaged by said notches.

4. The lock according to claim, 1, in which said components comprise a first train of coaxial toothed discs having notches formed therein, said lock also including a second train of toothed discs parallel to and in engagment with the toothed discs of said first train for driving the discs of said first train, each disc of said second train being provided on its periphery with a tooth, and a bar movable toward and away from the periphery of the disc of the second train for acting on the teeth to bring them into alignement.

5. A lock according to claim 4 including resilient means for maintaining said bar in one or another of two stable positions.

6. A lock according to claim 5 including a mechanism compartment mounted for rotational motion under the action of said first means, said bar being carried by said mechanism compartment.

7. A lock according to claim 1 including a first train of coaxial toothed discs in which said notches are formed, a second train of toothed discs parallel to said first train, the toothed discs of said first train being in engagement with the toothed discs of said second train, and a mechanism compartment actuatable by said first means and including means for sequentially selecting different ones of the discs of said second train.

8. A lock according to claim 7 having notches formed in the discs of said second train and including finger bearing plates for effecting selection of a disc of said second train by introduction of one of said plates into one of said notches.

9. A lock according to claim 8 in which one of said finger bearing plates is operative to open said latch and including means for preventing said finger bearing plate from moving away from its operating position until said mechanism compartment has been returned to a predetermined initial position.

10. A lock according to claim 8 including a multiplicity of finger bearing plates provided with apertures and adapted to cooperate with the discs of said second train, and means comprising a cylindrical block provided with counterbores for selectively moving said finger bearing plates toward and away from said second train in response to rotation of said cylindrical block.

11. A lock according to claim 10 including springs adapted to cooperate with said finger bearing plates so as normally to maintain them in a predetermined position.

12. A lock according to claim 1 including first and second trains of coaxial toothed discs parallel to each other, said notches being formed in the discs of said first train, said discs of said first train engaging discs of said second train and each disc of said second train having thereon a projecting tooth, and a bar actuatable by said first means for engaging said teeth during motion of said latch into its locked position to modify the setting of said notches.

13. A lock according to claim 12 including a V-shaped spring having two elastic resilient branches adapted to cooperate with said bar to maintain said bar in a predetermined normal position.

14. A lock according to claim 1 including first and second parallel trains of coaxial toothed discs mounted on shafts, said notches being formed in the discs of said first train and each disc of said second train having a radial abutment face, and a bearing surface secured against angular rotation relative to the shaft upon which said discs are mounted and adapted to cooperate with said radial abutment faces to limit the rotation of said discs in said second train.

15. A lock according to claim 1, wherein said first means comprises a setting button and a shaft which is made operational by a longitudinal motion along the axis of said shaft, and means for opposing such longitudinal motion as long as said button is not in a predetermined angular position.

16. A lock according to claim 15 including a toothed ring driven by said button and a fixed tooth adapted to cooperate with the teeth in said ring.

17. A lock according to claim 15 including a display dial on which are formed numerals for indicating the position of said notches, and including means for rendering said numerals invisible to an operator as long as said display button is not made operational by longitudinal motion thereof.

18. A lock according to claim 1 wherein said first means comprises a setting button, said second means comprises a selector button, and including resilient means between said setting button and said selector button for urging the selector button toward a projecting position with respect to the lock.

19. A lock according to claim 18 in which said display button includes a flange with internal notches for indicating the angular position of said selector button.

* * * * *

In order to make operational the first counter, the selector button 62 is depressed, which button is, as has been seen hereinabove, initially in the position "0". Starting from this condition, the selector button 62 is turned clockwise until the reference mark corresponding to the numeral "1" registers with the reference mark 53 which is carried by the display button 36, which corresponds to a rotation of a fifth of turn. The rotation of the selector button 62, drives the shaft 90, with which the button 62 is integral, as well as the pinion 561 fitted on said shaft. The pinion 561 drives the pinion 559 fitted onto the cylindrical multiple cam 329. Through this rotation, the finger bearing plate $333_0$ which because of the presetting action precedingly described was in a condition for which its finger $337_0$ was moved towards the axis 9, moves away from said axis, due to the cooperation of the cylindrical portion 330 of the cam 329 opposing the action of the springs $343_0$, $344_0$ which bear against the finger bearing plate $333_0$. During this movement away from the axis 9, the abutting edge 352 of said finger bearing plate acts upon the bar 358 and causes the arm 359 to pass the apex of the spring 361 and brings back the bar 358 to that condition for which it is away from the peripheral edge of the pinions 231; the bar 358 is maintained in that position by action of the branch 364' of the spring 361, as long as it does not cooperate with the ramp 536.

Also during this rotation of the selector button 62, when this button reaches the position for which the numeral "1" carried by the selector button registers with the reference mark 53 carried by the displaying button 36, the flat surface $331_0$ of the cam 330 enables the fingered plate $333_1$ to move towards the axis 9 under the action of the springs $343_1$ and $344_1$ and the finger 337 of said plate engages the notch 152 of the pinion $231_1$, said notch being then in face of said finger because of the "0" position of the displaying button 36. The selector button 62 is released, which button, by action of the spring 101, takes on again its projecting position. The displaying proper can now be proceded with, for the first number of the combination.

If, for instance, the first number to be displayed is the number "9", the display button 36 is depressed and turned clockwise until the number "9" appears opposite the reference mark 7' which is carried by the window 7. The rotational movement of the display button 36 drives the tubular shaft 23, and also the compartment 312 which is integral with said shaft. All the internal components inside compartment 312 and which are integral with said compartment in such rotational motion rotate about axis 9 and the finger 337, of the finger bearing plate 333, which is in engagement with the notch $152_1$of pinion $231_1$ drives said pinion in a rotary motion along an angular distance which corresponds to the number "9". In said condition of the compartment which corresponds to the position "1" of the selector button 62, the cylindrical block with counterbores 330 prevents the other fingers $337_2$, $337_3$, $337_4$ and $337_0$ from taking on a projecting position, and the corresponding registering pinions, i.e. $231_2$, $231_3$, $231_4$ and $231_0$ are not driven. The rotation of the pinion $231_1$ causes the pinion $261_1$ to rotate the same angular distance by means of the teeth $232_1$and $262_1$, thus bringing the notch $266_1$ of the pinion $261_1$ in the angular location which corresponds with the displaying of the number "9". If "9" is effectively the first number of the combination for which the opening of the safe is to take place, the notch $266_1$ is then in the position for which it is adapted to receive the bar 900 of the rake 583. The display button is released, which button, by action of the spring 26 takes on again its projecting position. The first number of the combination having thus been displayed, the displaying of the second number of the combination can be proceded with. To this effect, the selector button 62 is depressed and is once again caused to turn a fifth of a turn in the clockwise direction. When the selector button is released upon completion of said rotation, the action of the spring 101 brings it back to a projecting position, the tooth 61 thereon engaging a notch 42. This rotation of the selector button has driven in the same movement the shaft 90 and the latter, as in the preceding phase, causes the counterbored block or cylindrical cam 330 to turn. During the rotation of said cam, the finger bearing plate $333_1$ is moved back into a position away from the axis 9 against the action of the springs $343_1$ and $344_1$ which bear upon it, and the finger bearing plate $333_2$ is urged towards axis 9 instead, by action of the springs $343_2$ and $344_2$ which bear upon it as well as upon the finger $337_2$; it comes into contact with the peripheral edge of the flange $151_2$ of the pinion $231_2$; The selector button 62 being once again in the projecting condition, the display button 36 is returned to; the latter is depressed in order to disengage the teeth 18 from the tooth 13 and is brought back in an anticlockwise motion to the position for which the numeral "0" registers with the reference mark 7' of the window 7. For the latter position, the notch $152_2$ in the pinion $231_2$registers with the finger $337_2$ of the finger bearing plate $333_2$ and the finger $337_2$ penetrates into said notch by action of the springs $343_2$ and $344_2$ which bear upon it. For this position it is the numeral "2" on the scale of the selector button 62 which is read, and which thus characterises the counter for which the displaying is about to be made, which is here the second counter.

The second number of the combination to be displayed is displayed by actioning the display button 36 until the second number of the combination appears through the window 7, which action, as hereinbefore, drives selectively the pinion $231_2$ along an angular distance which corresponds with said number to be displayed.

And the same actions are carried out, on one hand after the displaying of a number, on the other hand for the displaying of a new number.

After the displaying of the fourth and last number of the combination, the display button 36 is released and takes on again its projecting condition. The selector button 62 is depressed, and is rotated in the clockwise direction once again, a fifth of a turn. By the same process as hereinbefore described, the finger bearing plate $333_4$ is moved away from the axis 9. Instead, the plate $333_0$ is urged towards the axis 9 and the frontal edge of its finger $337_0$ comes into contact with the peripheral edge of the flange of the pinion $231_0$. The display button 36 is depressed and is rotated in an anticlockwise motion until abutment. In the abutment condition, the finger $337_0$ of the finger bearing plate $333_0$ registers with the notch $152_0$ of the pinion $231_0$ and penetrates into said notch by action of the springs $343_0$ and $344_0$.

The following phase is the latch retraction phase. It is controlled by the same movement as that which has effected the display of the different numbers of the combination, i.e. by a rotation of the display button 36 in the clockwise direction. During said movement, the pinion $231_0$ meshes with the pinion $261_0$ and causes the latter to rotate. The curved edge 158 of the crest 154 runs before the bar 900 of the rake 583 until it makes possible the lowering of said bar. This bar is in face of the passage which is formed by the succession of notches $266_1$, $266_2$, $266_3$, $266_4$, then aligned as a consequence of the display of the numbers of the combination. During a first phase the pinion $261_0$ drives the drum 169 through action of the spring 164, the end arms 166 and 167 of which bear in a resilient manner against the flange 168, which form part of said drum. In this rotation of the drum 169, the small tie-bar 602 mounted for rotational movement onto the pin 604 which is integral with said drum, is pulled, and the eyelet 601 of its other end moves relatively to the pin 600, which is carried by the plate 591 which is integral with the rake 583. When the bottom of the eyelet comes into contact with the pin 600 carried by the plate 591, the continuation of the rotation of the drum 169 causes the plate 591 to rotate about the axle 574 and the bar 900 of the rake 583 moves towards the passage formed by the succession of notches $266_1$, $266_2$, $266_3$ and $266_4$ and penetrates inside said passage. The face 901 of the bar of the rake contacts the bottom portion $269_1$, $269_2$, $269_3$, $269_4$ of the notches.

As the rotational movement of the pinion $261_0$ is pursued, the set comprising the plate 591 and the rake 583 cannot be lowered further so that the drum 169 is brought to a standstill. The rotation of the pinion $261_0$ can however continue because of the sliding action of the ends 166 and 167 of the branches of the blade spring 165 against the walls of the drum 169.

During the pivotal movement of the rake plate 591 about the axle 574, the lever 610, which rests by its apex 609 (FIG. 63) on the raised edge 598 of the rake plate, pivots about its assembly axle 615, so that the hook 619 which terminates this lever adopts the position shown in dotted line in FIG. 63.

As long as the lever 610 is in the position shown in full line in FIG. 63, the rotation of the display button 36, which causes the plate 563 bearing the pin 569 to move in the same rotational movement, cannot drive the arm or lever 610, the path of said pin not meeting the hook 619. It is thus ensured that in the case a wrong combination is displayed, the actioning of the display button can on no account cause the lock to open. On the contrary, the position shown in dotted line, which corresponds to the lowering of the rake 583 into the passage 266, the pin 569 on the disk 563 encounters along its path, in the last portion of the run of the display button, the hook 619 of the lever 610, and exerts on said lever a force which, transmitted by means of the lever 610, ensures the retraction of the latch carrying the axle 615 onto which is mounted said lever.

Whereas for any position of the rake 581 and of the plate 591 which is integral with it, other than that which corresponds to the insertion position of the bar 900 of the rake inside the passage 266, the pawl 632 is in the position shown in full line, in which positon it is maintained by abutment of its face 902 against the fold 599 of the rake plate, preventing thus any external action which might cause the retraction of the latch; in the lowered position of the rake and of the rake plate however, the lowering of the fold 599, which takes on the position shown in dotted line in FIG. 63, thus causes the pawl 632 to adopt, against the action of a spring, the position shown in dotted line, for which the retraction of the latch is made possible.

Whereas in the position shown in full line in FIG. 63, the catch 631 of the pawl 632 opposed in a positive manner the retraction movement of the latch, in the position shown in dotted line, it enables this retaction to take place by action of the lever 610 owing to the rotary motion of the pin bearing disk as explained hereinbefore.

At the end of the run of the display button 36, which has become opening button, the cylindrical portion 158 of the crest 154 engages by its end 155 the bar 900 of the rake 583, and this latter pivots in a direction reverse to the preceding movement through rotation about axle 574, the pivotal movement being unhindered by effect of the friction link which exists between the drum 169 and the pinion $261_0$, the drum 169 being linked with the rake plate 591 through the small tie-bar 602. Then, at the end of the opening stroke of the button 36, at abutment position, the pinions $261_1$, $261_2$, $261_3$, $261_4$ are again free to rotate. At the end of its stroke also, the bar 358 carried by the arms 359 and 361, and the set comprising the mixer, are moved towards the axis 9 by action of the ramp 156, so that the bar 358 comes into contact with the peripheral edge of the pinions $261_1$, $261_2$, $261_3$, $261_4$, $261_0$.

The latch being retracted, the door can be opened.

As long as the display button is not actioned again, the door can be opened or closed.

When it is again desired to bring the latch in projecting position, the display button 36 is turned in the anticlockwise direction up to the other abutment position. As soon as this movement is initiated, the bar 358, which slides along the peripheral edges of the pinions $231_1$, $231_2$, $231_3$, $231_4$, $231_0$ causes the pinions 231 to rotate by pushing forwards their projecting tooth 234; the pinions 231, although meshing with the pinions 261, being however able to rotate by the fact that the bar 900 of the rake 583 is now out of the passage formed by the succession of notches $266_1$ to $266_4$.

During the rotation of the display button towards its initial abutment position, the pin 570 carried by the disk 563 comes to bear against the tail 628 of the latch 614, driving this latter towards its projecting position until closure condition, which is obtained when the display and driving button 36 is brought back to its "0" position. For this position also, all the teeth $234_1$, $234_2$, $234_3$, $234_4$ are also brought back to their "0" position.

When the selector button 62 is in its "0" position and the finger $337_0$ of the finger bearing plate $333_0$ is in its position twoards the axis 9, the interdiction lever or pawl 541, by effect of its spring 546, is in the position shown in FIG. 89 in abutment with the tab $345_0$ of the finger bearing plate $333_0$. For this position, its face 903 is opposite the extension 357 of the finger bearing plate $333_0$ and forbids any movement of the finer $337_0$ away from the axis 9.

As long as the display button is not brought back to its initial abutment condition, the interdiction lever 541 remains in the position shown in FIG. 89. If then, inadvertantly the owner or renter of the safe attempts at that moment to obtain the opening by displaying anew the combination, his first action consists, as has been seen, in bringing the selector button 62 from the position "0" which it had for the prior opening, to the position "1" for the display of the first number. But the rotation of the cam cylinder 330 will then be impossible as said cam cylinder will be unable to move the finger bearing plate $333_0$ away from the axis 9, the finger bearing plate abutting then against the frontal face 903 of the interdiction lever. It will then be impossible to bring the selector button 62 in the position "1" and the operator will thus

UNITED STATES PATENT OFFICE

CERTIFICATE OF CORRECTION

Patent No. 4,100,776 Dated July 18, 1978

Inventor(s) Francois Guiraud

It is certified that error appears in the above-identified patent and that said Letters Patent are hereby corrected as shown below:

Column 5, line 2 change "thickenss" to --thickness--.
Column 6, line 25 after "will" insert --not--.
Column 8, line 25 change "betwen" to --between--.
Column 8, line 38 change "189" to --289--.
Column 8, line 47 change "correpsonding" to --corresponding--.
Column 9, line 12 change "intrnal" to --internal--.
Column 9, line 21 change "notches" to --notched--.
Column 9, line 21 change "couterbores" to --counterbores--.
Column 9, line 23 change "3314" to --$331_4$--.
Column 9, line 24 change "bein" to --being--.
Column 9, line 33 change "figner" to --finger--.
Column 9, line 56 change "mixaing" to --mixing--.
Column 9, line 61 change "rspectively" to --respectively--.
Column 9, line 62 change "springm" to --spring--.
Column 10, line 11 change "opertional" to --operational--.
Column 10, line 21 change "55" to --555--.
Column 10, line 59 change "co-operats" to --co-operates--.
Column 11, line 2 change "againgt" to --against--.
Column 11, line 16 change "cureved" to --curved--.
Column 11, line 18 change "firs" to --first--.

UNITED STATES PATENT OFFICE

CERTIFICATE OF CORRECTION

Patent No. 4,100,776 Dated July 18, 1978

Inventor(s) Francois Guiraud

It is certified that error appears in the above-identified patent and that said Letters Patent are hereby corrected as shown below:

Column 5, line 2 change "thickenss" to --thickness--.
Column 6, line 25 after "will" insert --not--.
Column 8, line 25 change "betwen" to --between--.
Column 8, line 38 change "189" to --289--.
Column 8, line 47 change "correpsonding" to --corresponding--.
Column 9, line 12 change "intrnal" to --internal--.
Column 9, line 21 change "notches" to --notched--.
Column 9, line 21 change "couterbores" to --counterbores--.
Column 9, line 23 change "3314" to --$331_4$--.
Column 9, line 24 change "bein" to --being--.
Column 9, line 33 change "figner" to --finger--.
Column 9, line 56 change "mixaing" to --mixing--.
Column 9, line 61 change "rspectively" to --respectively--.
Column 9, line 62 change "springm" to --spring--.
Column 10, line 11 change "opertional" to --operational--.
Column 10, line 21 change "55" to --555--.
Column 10, line 59 change "co-operats" to --co-operates--.
Column 11, line 2 change "againgt" to --against--.
Column 11, line 16 change "cureved" to --curved--.
Column 11, line 18 change "firs" to --first--.

UNITED STATES PATENT OFFICE

CERTIFICATE OF CORRECTION

Patent No. 4,100,776 Dated July 18, 1978

Inventor(s) Francois Guiraud

It is certified that error appears in the above-identified patent and that said Letters Patent are hereby corrected as shown below:

Column 11, line 18 change "flnge" to --flange--.
Column 11, line 19 change "rets" to --rests--.
Column 11, line 62 change "mens" to --means--.
Column 12, line 15 "f" should read -- of --.
Column 12, line 40 change "fpring" to --spring--.
Column 16, line 47 change "twoards" to --towards--.
Column 16, line 52 change "finer" to --finger--.
Column 18, line 17 change "indiation" to --indication--.
Column 18, line 53 change "alignement" to --alignment--.

Signed and Sealed this

Sixth Day of March 1979

[SEAL]

Attest:

RUTH C. MASON
Attesting Officer

DONALD W. BANNER
Commissioner of Patents and Trademarks